US008387987B2

(12) United States Patent
Snow et al.

(10) Patent No.: US 8,387,987 B2
(45) **Date of Patent: *Mar. 5, 2013**

(54) CASINO POKER GAMES

(75) Inventors: Roger Snow, Las Vegas, NV (US); Mark Yoseloff, Henderson, NV (US); Stacy Friedman, Beaverton, OR (US); Jon Muskin, Philadelphia, PA (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/411,576

(22) Filed: Mar. 4, 2012

(65) Prior Publication Data

US 2012/0161395 A1 Jun. 28, 2012

Related U.S. Application Data

(63) Continuation of application No. 12/423,773, filed on Apr. 14, 2009, now Pat. No. 8,128,091, and a continuation-in-part of application No. 12/189,775, filed on Aug. 11, 2008, now abandoned, which is a continuation-in-part of application No. 11/242,636, filed on Oct. 3, 2005, now Pat. No. 7,410,172.

(60) Provisional application No. 61/109,928, filed on Oct. 31, 2008, provisional application No. 60/615,225, filed on Oct. 1, 2004.

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | |
|---|---|---|---|---|
| 4,364,567 | A * | 12/1982 | Goott | 273/237 |
| 4,948,134 | A * | 8/1990 | Suttle et al. | 463/13 |
| 5,022,653 | A * | 6/1991 | Suttle et al. | 463/13 |
| 5,100,137 | A * | 3/1992 | Fulton | 463/13 |
| 5,732,950 | A * | 3/1998 | Moody | 273/292 |
| 5,823,873 | A * | 10/1998 | Moody | 463/13 |
| 6,027,119 | A * | 2/2000 | De Lisle | 273/292 |
| 6,332,614 | B1 * | 12/2001 | Hesse | 273/292 |
| 6,379,245 | B2 * | 4/2002 | De Keller | 463/13 |
| 7,222,858 | B2 * | 5/2007 | Moody | 273/292 |
| 2002/0008356 | A1 * | 1/2002 | De Keller | 273/292 |
| 2006/0071427 | A1 * | 4/2006 | Van Dyke | 273/292 |

* cited by examiner

*Primary Examiner* — Alvin A. Hunter
*Assistant Examiner* — Dolores Collins
(74) *Attorney, Agent, or Firm* — Muskin & Cusick LLC

(57) ABSTRACT

A method, system, and computer readable storage medium to provide a player versus dealer poker game which allows the dealer to raise based on the contents of the dealers unrevealed hand. The player can then choose to match the dealer's raise or fold. Then, both the player's hand and the dealer's hand are revealed, and the higher hand wins.

11 Claims, 12 Drawing Sheets

CASINO POKER GAMES

CROSS REFERENCE TO RELATED APPLICATIONS

This application is a continuation application of application Ser. No. 12/423,773, now allowed, which: A) claims benefit to U.S. provisional application 61/109,928, which is incorporated by reference herein in its entirety; B) application Ser. No. 12/423,773 is also a continuation in part of U.S. application Ser. No. 12/189,775, which is a continuation in part of issued U.S. Pat. No. 7,410,172, which claims benefit to U.S. provisional application 60/615,225, all four of these documents (application Ser. No. 12/423,773; application Ser. No. 12/189,775; U.S. Pat. No. 7,410,172; application 60/615,225) are all incorporated by reference herein in their entireties.

BACKGROUND OF THE INVENTION

1. Field of the Invention

The present inventive concept relates to a system, method, and computer readable storage, directed to casino poker games.

2. Description of the Related Art

Casino games are a billion dollar industry, both in the U.S. and around the world.

What is needed is a new poker game which can increase player enjoyment as well as casino revenue.

SUMMARY OF THE INVENTION

It is an aspect of the present general inventive concept to provide enjoyable casino poker games.

The above aspects can also be obtained by a method that includes (a) making at least one ante wager to participate in a game of chance; (b) automatically forming at least partial player and dealer hands, wherein a composition of the at least partial dealer hand composition is known prior to delivery; (c) a dealer delivering at least one partial player hand to a player hand position and at least a partial hand of cards to a dealer hand position; (d) a dealer delivering at least a partial hand of dealer cards to a dealer position, at least one of the cards remaining face down; (e) a player viewing the at least a partial hand of player cards; (f) a processor randomly selecting a player instruction from a lookup table of at least partial hand value of the dealer cards and corresponding instructions, wherein the instructions are assigned a relative weight; (g) displaying the randomly selected instruction to each player, the instruction generally indicating a strength of the dealer's hand without a dealer's actual knowledge of dealer hand composition; and then (h) each player folding or making a play bet that is consistent with the displayed instruction; (i) revealing the at least partial hand of dealer cards; (j) comparing a rank of each player hand to a rank of the dealer's hand; and (k) determining a game outcome.

The above aspects can also be obtained by an apparatus that includes (a) a gaming table; (b) a device for automatically forming randomly arranged groups of cards, the groups to be delivered as hands or partial hands in a card game, wherein the device reads the rank and suit of each card and stores a hand composition in associated memory; (c) a player display for displaying player wagering instructions; and (d) a processor associated with the apparatus that is programmed with the game rules for at least player vs. dealer play, and a look up table for randomly selecting and displaying player instructions corresponding to a dealer hand composition. The apparatus can also include the player display is mounted into the gaming table. The apparatus can also include that the device for automatically forming randomly arranged groups of cards is a card shuffler. The apparatus can also include that the lookup table includes categories of poker hand values. The apparatus can also include that the player instructions are selected from the set consisting of a check or a whole integer multiple between 1 and 10. The apparatus can also include that the integers are between 1 and 3. The apparatus can also include that the player instructions instruct the player to make a play wager that is an amount equal to either the ante times the displayed instruction or two times the ante times the displayed instruction.

The above aspects can also be obtained by an apparatus that includes (a) a physical deck of cards; (b) a hand forming automatic shuffler with an embedded scanner; (c) a processing device that performs: (d) reading one or more cards forming a dealer's hand and determining, based on a category of the dealer's hand, a dealer's action using predetermined rules that incorporate a random element; and (e) a display to display the dealer's action to players. The apparatus can also include a data structure that is used by the determining that comprises an association of different hand categories with respective dealer actions and an association of the dealer actions with respective probabilities.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
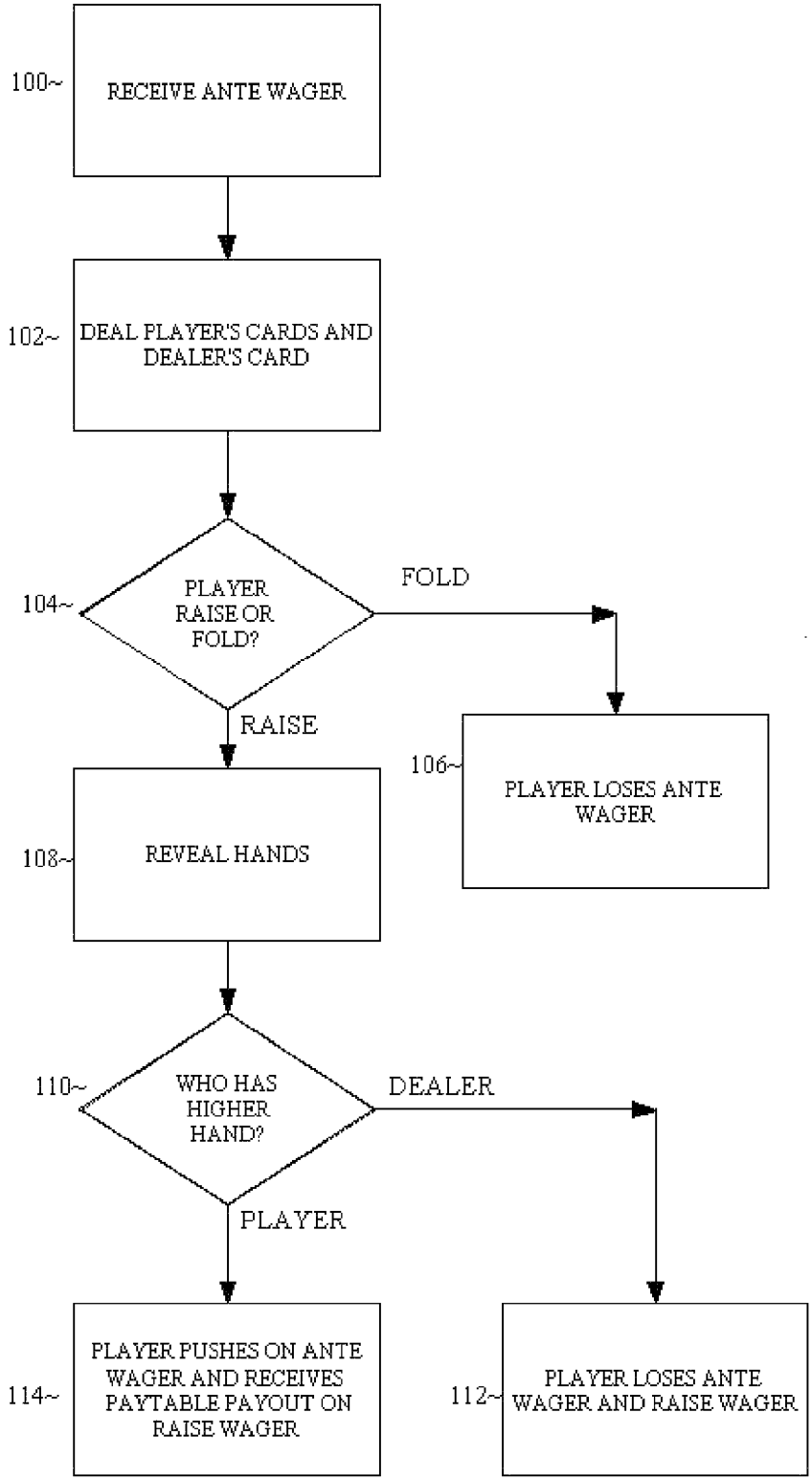
FIG. 1 illustrates an exemplary method of implementing a poker game, according to an embodiment.

Reference will now be made in detail to the presently preferred embodiments of the invention, examples of which are illustrated in the accompanying drawings, wherein like reference numerals refer to like elements throughout.

The present inventive concept relates to various implementations of a casino poker game played between a player and a dealer.

FIG. 1 illustrates an exemplary method of implementing a poker game according to an embodiment.

The method can start with operation 100, which receives an ante wager (typically from a player).

From operation 100, the method can proceed to operation 102, which deals player cards and dealer cards. Any number of cards can be used (e.g. 2, 3, or more).

From operation 102, the method can proceed to operation 104, wherein the player decides whether to raise or fold. If the player folds, then the method can proceed to operation 106, wherein the player loses his or her ante wager.

If the player raises then the method can proceed to operation 108, which reveals hands (both the player's and the dealer's).

From operation 108 the method can proceed to operation 110, which determines who has the higher hand. If the player has the higher hand, then the method can proceed to operation 114, wherein the player pushes on the ante wager and receives a paytable payout on the raise wager.

If the dealer has the higher hand then the method can instead proceed to operation 112, wherein the player loses both the ante wager and the raise wager.

Figure 2:
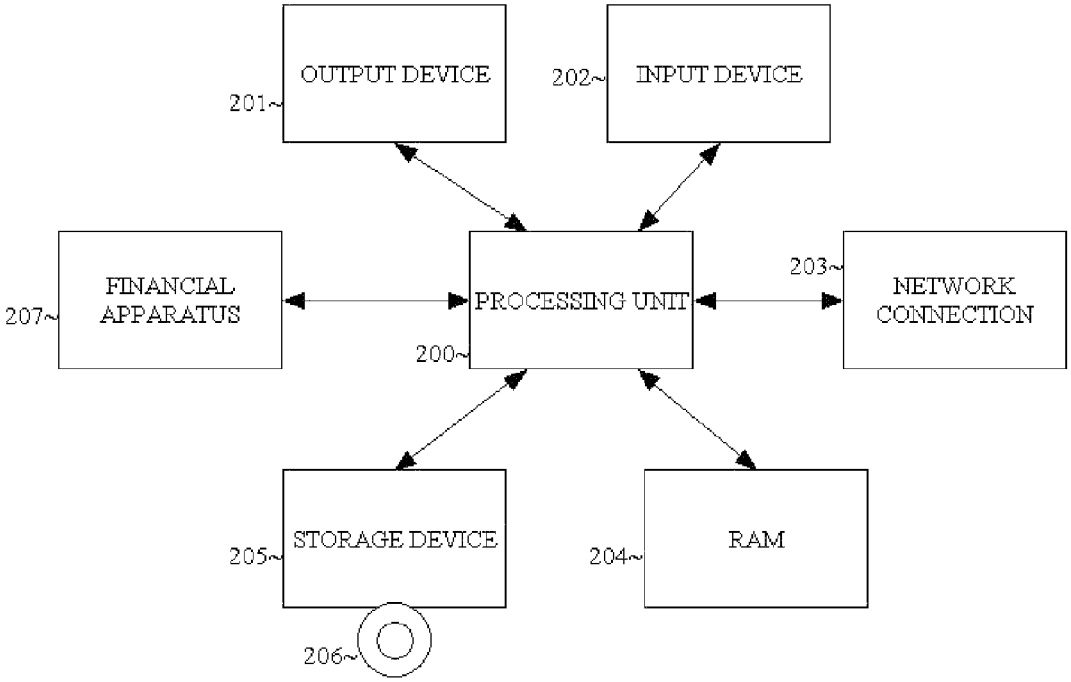
FIG. 2 is a block diagram illustrating sample hardware that can be used to implement an electronic version of the methods described herein, according to an embodiment.

FIG. 2 is a block diagram illustrating sample hardware that can be used to implement an electronic version of the methods described herein, according to an embodiment. Electronic versions of the game can be played on an electronic gaming device or online using a computer client connected to the Internet.

A processing unit 200 can be connected to an output device 201 such as a touchscreen, CRT, plasma display, etc. The processing unit 200 is also connected to an input device, such as a touchscreen, keyboard, mouse, etc. The processing unit 200 is also connected to a network connection 203 which can connect to any type of computer communications network, such as a LAN, WAN, the Internet, etc. The processing unit 200 is also connected to a RAM 204 and a storage device 205 which can be a ROM, hard drive, CD-ROM, DVD drive, or any known storage device. Computer readable storage medium 206 can be a CD, DVD, etc., which stores assets (programs, media files, etc.) which can be used to control a computer to implement the methods described herein. The processing unit 200 can also be connected to a financial apparatus 207 which on an electronic gaming device located in a casino can be used to collect cash from a player and to pay payouts to the payer (either in the form of cash, coins, tickets, or electronic payouts).

Figure 3:
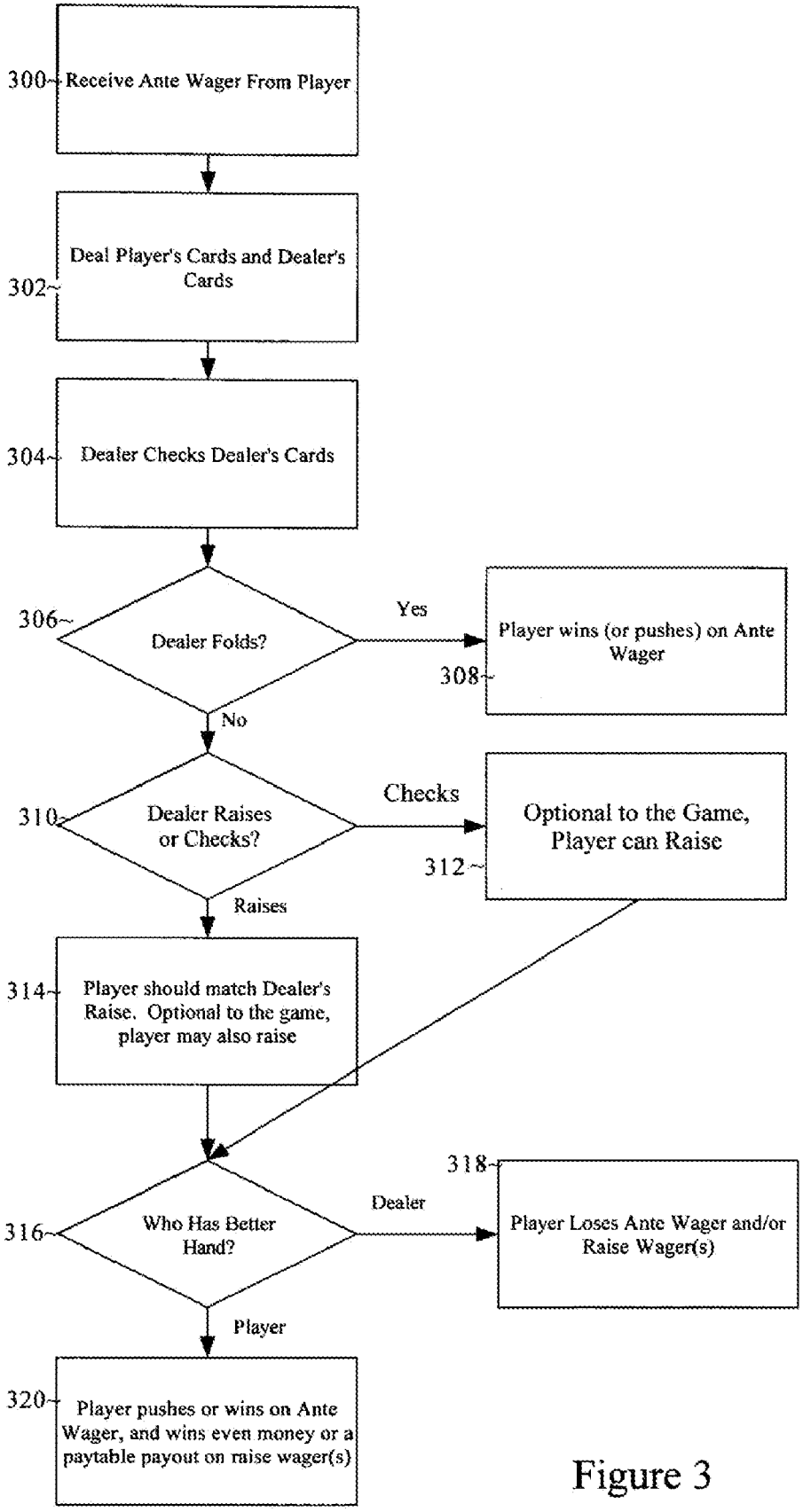
FIG. 3 is a flowchart illustrating a method of implementing a poker game involving a dealer raise according to an embodiment.

FIG. 3 is a flowchart illustrating a method of implementing a poker game involving a dealer raise according to an embodiment.

The method can begin with operation 300, which receives an ante wager from a player.

From operation 300, the method can proceed to operation 302, which deals player's cards and dealer's cards. Any number of cards can be used for each of the player's hand and dealer's hand (e.g., 2, 3, 4, 5, or more).

From operation 302, the method proceeds to operation 304, wherein the dealer checks the dealer's cards. This evaluation can be performed by a human dealer actually peeking at the cards (that are dealt face down) or an electronic scanning apparatus that can scan the cards (which are dealt face down) and recognize the card values. Alternatively, in another embodiment, one or more of the dealer cards may be revealed after being dealt and evaluated.

From operation 304, the method proceeds to operation 306 which determines whether the dealer folds. If the dealer has a poor hand, the dealer may decide to fold (although other criterion can be used as well). If the dealer folds then the method can proceed to operation 308, wherein the player wins a payout (or pushes, depending on the embodiment) on the ante wager. The game can then end here. Operations 306-308 can be optional, that is, in another embodiment, the dealer would never fold. In another embodiment, one or more dealer cards may be revealed.

If the dealer does not fold in operation 306 (or the dealer never folds), then the method proceeds to operation 310, which determines and displays whether the dealer raises or checks (does not raise). This can be done by evaluating the content of the cards of the dealer's hand (from operation 304) which the players are not able to view. Alternatively, some (but not all) of the dealer's cards in the dealer's hand may be available for the player to view (e.g., one or more of the dealer's cards can be turned face up while the remaining dealer's cards are face down).

The determination of whether the dealer raises, and by how much, can be done based on a table. For example, if the dealer has a predetermined rank or better (e.g., a pair of kings or better) out of a five card hand, then the dealer may raise 2× the ante amount (e.g. if the player antes $5, the raise is $10 and thus the player would have to bet another $10 to stay in the game in operation 314). If the dealer has an ace high or better (but not a pair of kings or better) then the dealer may raise 1× the ante amount. If the dealer does not even have an ace high, then the dealer may not raise at all (the dealer would check). Of course, these rules are merely examples and any other set of rules can be implemented to determine whether the dealer raises or not and how much.

In addition to using the content of the dealer's cards to determine whether to raise (and how much) in operation 310, other factors can be used as well. For example, a random factor can be used to determine the dealer's raise. For example, the rules in the previous paragraph can be implemented with the following addition: if the dealer checks according to the prior rules (e.g., the dealer does not have an ace high or greater) then the dealer would raise 2× the ante with an X % (e.g., 10%) probability. This can be considered a "bluff" by the dealer since the dealer does not have a good hand. This random factor can be used to throw the player off and generate excitement to the game. Of course any probabilities and raise amount rules can be used, including multiple rules (e.g. if the dealer does not have an ace high or greater, the dealer would raise 1× the ante with 15% probability and raise 2× the ante with 5% probability). Another way to look at this is that the dealer would automatically raise with an X % probability (or X % for 1× and Y % for 2×, etc.), and if not, then the dealer would still raise if the dealer's hand is greater than (or greater than or equal to) a predetermined hand. The random probability can be weighted to produce a desired frequency of bluffing, and the probability can be generated in any suitable fashion, for example by any computer-based pseudo-random number generator algorithm as known in the art (such as those commonly used in electronic gaming machines), or any suitable physical or temporal source of randomness (e.g. a millisecond counter, or a radioactive isotope sensor). Thus, a "random element" can be incorporated into the dealer's play strategy, wherein the set of house rules for determining the dealer strategy comprises using a random number generator in addition to taking into consideration the composition of the dealer's cards which are not viewable to the player when the dealer computes and displays the dealer's strategy.

In addition to a predetermined bluff probability (or set of predetermined bluff probabilities) when the dealer's hand is beneath a threshold, the dealer may bluff with a probability determined based on the cards (or evaluated hand value) he holds. For example, consider a three-card poker game embodiment: the dealer may always raise with a pair or higher. With a jack-high or better, the dealer may bluff-raise 10% of the time, but with only a 5-high the dealer may bluff-raise 15% of the time.

In another embodiment, the dealer will always raise a minimum amount in operation 310 (for example, 1× ante, or 2× ante, as opposed to checking). This can be considered making a minimum bet, even though the dealer would not actually make a physical wager with chips (because it is understood that the casino dealer accepts all player wagers). This can also be considered a "wager instruction", that is, instructing the player what the dealer's action is intended to be. The player will then be forced to call the dealer's minimum bet/wager instruction (e.g. 1× or 2×) or fold, as checking (betting zero) will not be an option. In other words, when the dealer's hand and random factor do not indicate making a raise of a larger amount, the dealer would always bet a minimum nonetheless.

In another embodiment, the dealer may not raise 100% of the time with a hand of sufficient rank. The dealer may, for example, decline to raise with a flush, 10% of the time. This can be considered a "trap" or "slow-play". To generalize both the "slow-play" and "bluff", the dealer may have a raise probability of P_i for each possible hand H_i, where each P_i may range from 0% to 100%.

Further, in another embodiment combining several features herein, the dealer may have a raise probability of P_ik for each possible hand H_i and each allowable raise amount R_k, where each P_ik may range from 0% to 100%, and where each sum of (P_ik) for a given H_i over all R_k, (where, for completeness, one of the allowable R_ks is not to raise but to check (or make a minimum bet as described herein, or fold)) equals 100%. In this embodiment, a randomly generated probability is compared against the various P_iks for a given hand H_i to determine which dealer action (raise 1×, raise 2×, check, fold, etc.) will occur.

As an example of this embodiment, consider a poker game using three cards per hand and played with a single standard deck of playing cards. There are 22,100 distinct combinations of three cards from a standard 52-card deck. If the dealer's allowable strategy actions are Raise 1×, Raise 2×, or Check, then there are 66,300 probabilities P_ik, and 22,100 sets of probabilities that add up to 100% (since the dealer may only perform one of the three listed actions, the sum of the probabilities for all three must be 100%). For example, if the dealer's hand were Ace of spades, Ace of hearts, and Ace of clubs, the dealer may have the following probabilities: Check, 0%; Raise 1×, 20%; Raise 2× 80%. A similar set of probabilities would exist for the remaining 22,099 other hand combinations. In another embodiment, the raise strategy probabilities for each hand need not be individually specified, but may be grouped by rank or ranks (such as "all pairs" or "flush or higher").

In another embodiment, the probabilities P_ik may be fixed and predetermined, or may vary over time based on other factors. For example, in a five-card poker game embodiment the probability of a dealer raising with a 9-high hand may normally be 10%. However, if on the preceding hand the dealer held four-of-a-kind and was beaten by the player (an occurrence commonly known as a "bad beat" in poker), the dealer may go "on tilt" for one or more subsequent hands. During those hands where the dealer is "on tilt", the raise probability may be increased for certain hands. For example, the probability of the dealer raising with a 9-high may be 40% while the dealer is "on tilt". To further generalize, a specific game outcome in a prior hand or hands (e.g. a "bad beat", all players folding, or another occurrence) may modify the normal dealer-raise probabilities for one or more hands, either upwards or downwards (or mixed). In an embodiment, the player is notified (via a visual display, verbal cue, indicator light, etc.) that the dealer is "on tilt", "playing like a rock", or another suitable phrase that indicates the dealer's raise probability distribution (i.e. the set of P_i or P_ik) has been modified. Preferably, the phrases are taken from poker parlance. In another embodiment, the player is notified what that dealer-raise probability distribution is, and/or how it differs from the "normal" dealer-raise probability distribution. In another embodiment, the player also knows the normal dealer-raise probability distribution.

From operation 310, if the dealer checks (does not raise) then the method proceeds to (optional) operation 312 wherein the player can raise. The player, after viewing his or her hand, can decide to place an additional raise wager on the table (e.g., 1 or 2 times the ante wager, or more).

If the dealer raises (or makes a minimum bet), which effectively requires the player to place additional wager(s) to stay in the game, in operation 310, then the method proceeds to operation 314, wherein the player should place a match wager which matches the dealer's raise. Thus, in operation 310, if the dealer raises $5, the player must place a match wager of $5 (in addition to the ante wager placed in operation 300). The dealer does not need to actually place any wagers on the felt in order to "raise" but can merely indicates the wager instruction to the player as described herein.

From operation 314 (or operation 312) the method proceeds to operation 316, which determines who has the higher ranked poker hand, the dealer or the player. Standard poker rules can be used in determining hand ranks. For example, see U.S. Pat. No. 6,698,759, which is incorporated by reference herein in its entirety. In another embodiment, the dealer-raise concept described herein may be applied to non-poker games. For example, in blackjack, the dealer may be able to indicate a raise of the player's wager (e.g. "double down" in blackjack parlance by making a 1× raise of the player's wager, or make a higher amount) prior to any player actions, and the player would thus need to increase her wager in order to proceed with the hand (or fold and forfeit the initial wager).

If in operation 316 it is determined that the dealer has the higher ranked poker hand, then the method proceeds to operation 318, which takes the player's ante wager, any match wager placed, and any raise wager placed (basically all wagers that the player has placed during this game).

If in operation 316 it is determined that the player has the higher ranked poker hand, then the method proceeds to operation 320, wherein the player pushes or wins on the ante wager (depending on house rules) and wins on any other wagers placed (e.g., raise wagers and/or match wagers). The player can win even money on these wagers or a payout based on a multiplier table. The payout multipliers may be greater than zero but less than even-money (e.g. a win of 4-to-5, indicating a $5 bet wins $4), or may be any multiple 1× or higher, including non-integral multiples.

FIG. 4 is a perspective drawing of a gaming table with an electronic dealer action display, according to an embodiment. An electronic dealer action display can be used to indicate to the players what the dealer's action is, such as check, raise 1×, etc. (even though the dealer does not actually make physical wagers), which therefore can act as an indicator of what the player's options are if the player wants to remain in the game. The electronic dealer action display can be activated by the press of a button by the dealer, that is, when the cards in the dealer's hand have all been scanned the dealer can press the button at the appropriate point in the game (e.g. after all cards have been dealt) in order for the electronic apparatus to determine the dealer's strategy based on the dealer's hand, or can be activated automatically at the appropriate point.

A gaming table 400 is used in order to implement methods described herein. A player's wager 402 is placed on the table 400. A player's hand 404 and a dealer's hand 406 are dealt out of a shoe 410. A dealer's action display 408 can be an electronic display which is used to automatically display the dealer's action (strategy) to the players. Alternatively, the dealer's action can be denoted using a non-electronic display (e.g. a printed lammer, or a marker in conjunction with a printed area of the table, similar to how the dealer's puck in casino craps denotes the point number). Ideally, the dealer's strategy can be determined by electronically scanning the cards so that the dealer himself or herself does not have to see the cards (which may be conducive to cheating), but of course the dealer can evaluate the cards manually. When the dealer is ready to display the dealer's strategy, the dealer can press a button associated with the dealer's action display 408 (not pictured), wherein an electronic device (such as a computer) determines the dealer's strategy based on predetermined rules (including any random number generation). In the example shown, the display 408 indicates that the dealer's strategy is to "RAISE 1×" since a light next to this strategy is lit. The raise amount indicated on the display (e.g., "1×," "2×") indicates the multiple of the player's ante wager (or other wager that the player has placed) that the player must then wager to stay in the game. Of course, the gaming table 400 can accommodate any number of players (e.g., 1-7 for a typical blackjack-sized table). Only one player location is shown in FIG. 4.

Figure 4A:
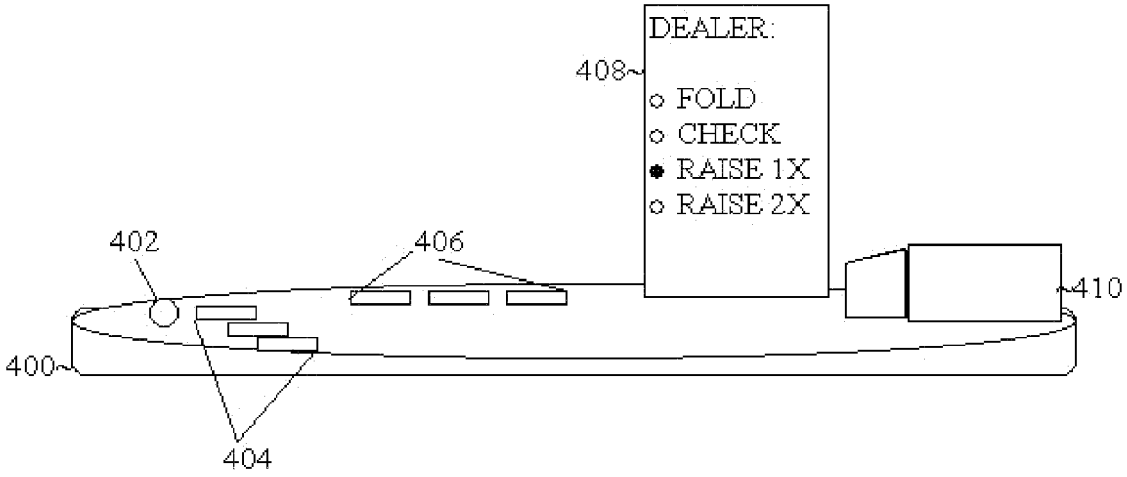
FIG. 4A is a perspective drawing of a gaming table with an electronic dealer action display, according to an embodiment.
Figure 4B:
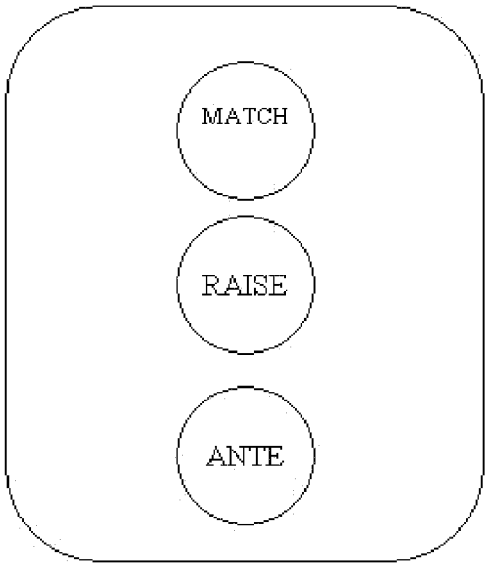
FIG. 4B is a drawing of an exemplary betting area on a gaming able for a player, according to an embodiment.

FIG. 4B is a drawing of an exemplary betting area on a gaming able for a player, according to an embodiment.

FIG. 4B has separate betting areas for an ante wager, raise wager, and match wager (as described in FIG. 6), but of course only betting circles that are needed for the current embodiment being implemented would be used on the gaming table felt. For example, in an embodiment where the player has only the single option to either match (call) or raise the dealer, a single wagering area may be used to receive such player wagers. Also not shown are additional betting circle(s) for side wagers, such as one that pays on the initial poker hand dealt to the player based on its rank.

Figure 5:
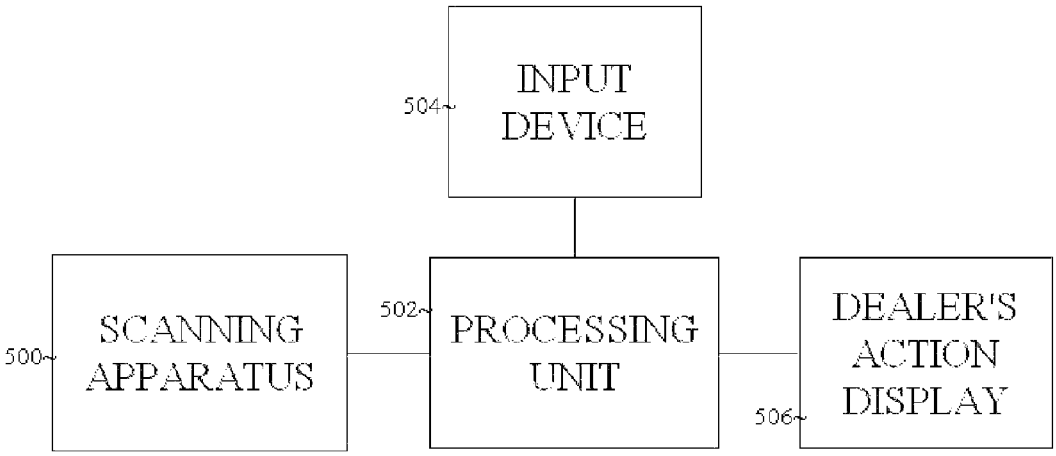
FIG. 5 is a block diagram of a scanning apparatus and dealer's action display, according to an embodiment.

FIG. 5 is a block diagram of a scanning apparatus and dealer's action display, according to an embodiment.

A scanning apparatus 500 can be a flat scanner that can be on the table itself. Cards forming the dealer's hand are placed on the scanning apparatus 500 can then be digitized and recognized according to optical character recognition. In this manner, the dealer does not have to look at the cards in the dealer's hand. In addition to a flat scanner, other mechanisms to electronically scan the cards can be used, such as a dealing shoe with an embedded scanner, an automatic shuffling machine that automatically deals a hand or partial hand of N cards at a time (e.g., 3 or 5) which can automatically scan each card in the N card hand, or any other method to automatically determine cards without using human recognition.

The scanning 500 apparatus is connected to a processing unit 502. Digitized signals from the scanning apparatus 500 are sent to the processing unit 502 so that the signals can be passed through an optical character recognition algorithm to determine the values of each of the cards in the dealer's hand. The processing unit can be located in the scanning device (for example, in the table, or in the dealing shoe, or in the shuffling machine) or can be located separately (for example, the scanner is in the dealing shoe but the processing unit is under the gaming table, or is in another room and is connected via a network to the shoe). Once the entire dealer's hand is determined, the dealer's action (strategy) can then be determined by the processing unit 502 according to predetermined rules (such as any of the predetermined rules as described herein). An input device 504 can be used by the dealer in order to communicate with the processing unit 502. For example, when the dealer is ready for the dealer's action display 506 to display the dealer's action, the dealer can interact with the input device 504 (e.g., press a button) which then activates the dealer's action display. Alternatively, the processing unit 502 can automatically determine the appropriate point during the game to display the dealer's action, and the input device 504 may not be necessary. The processing unit 502 transmits a signal representing the dealer's action to the dealer's action display 506, which then displays the dealer's action to the players. The display of the dealer's action can be done in numerous ways, such as using a digital readout, illuminated sign, etc.

It is advantageous to form whole or partial hands of cards within a card-reading shuffler because any deviation in hand composition between the shuffler and the table can be readily detected. In other words, if the shuffler randomly forms a hand of three particular cards, and those three particular cards ultimately end up in different players' hands, then obviously there was an illegal trading of cards between players. Surveillance or other mechanisms can be used to check the integrity of the hands dealt. If a variation from what is dealt is detected, then an appropriate alert can be sent (e.g., calling the pit boss, noting the incident in a computer, etc.)

Thus, the dealer can deal the game, and at the point in the game when the dealer's action is to be displayed, the dealer can press a button which activates the dealer's action display. Thus, the game can be dealt without the dealer seeing any of the cards in the dealer's hand, until it is time for the dealer to reveal the dealer's hand to the players. In this way, opportunities for cheating or collusion by the dealer are reduced.

An example of this game will now be presented. A player places a $5 ante wager. The player is then dealt three cards: Ace of hearts, ten of spades, three of clubs. The dealer is dealt three cards face down: nine of diamonds, two of clubs, three of hearts, which are not visible to the player. The dealer's cards are (or have already been) scanned by an electronic scanner. According to the house rules, the dealer would raise an amount equal to the player's ante wager if the dealer's hand is a king high or better, or 15% of the time determined randomly if the dealer does not otherwise raise.

In this example, the dealer's hand does not qualify for the raise (since it is not a king high or better) but according to a random determination (or other determination which has a random distribution in the long term), the 15% of the time has occurred. Thus the dealer indicates a raise of 1× the amount of the player's ante wager. This can be indicated to the player by a light flashing which is associated with the scanner, the human dealer verbally indicating the raise, etc. The player now places a $5 match wager to call the dealer's raise. Alternatively, the player could have decided to fold, lose his $5 ante wager and end the game. In another alternative, the player could also have decided to raise and make an additional $10 wager (instead of just the $5 match wager).

After the player places the $5 match wager, the dealer reveals the dealer's hand to reveal a poker rank of 9-high. The player has ace high. Thus, the player has the higher ranking poker hand and wins the game. The player wins $5 on the ante wager and $5 on the match wager and also receives his original $10 in wagers back. Thus, the player has a net win of $10.

Figure 6:
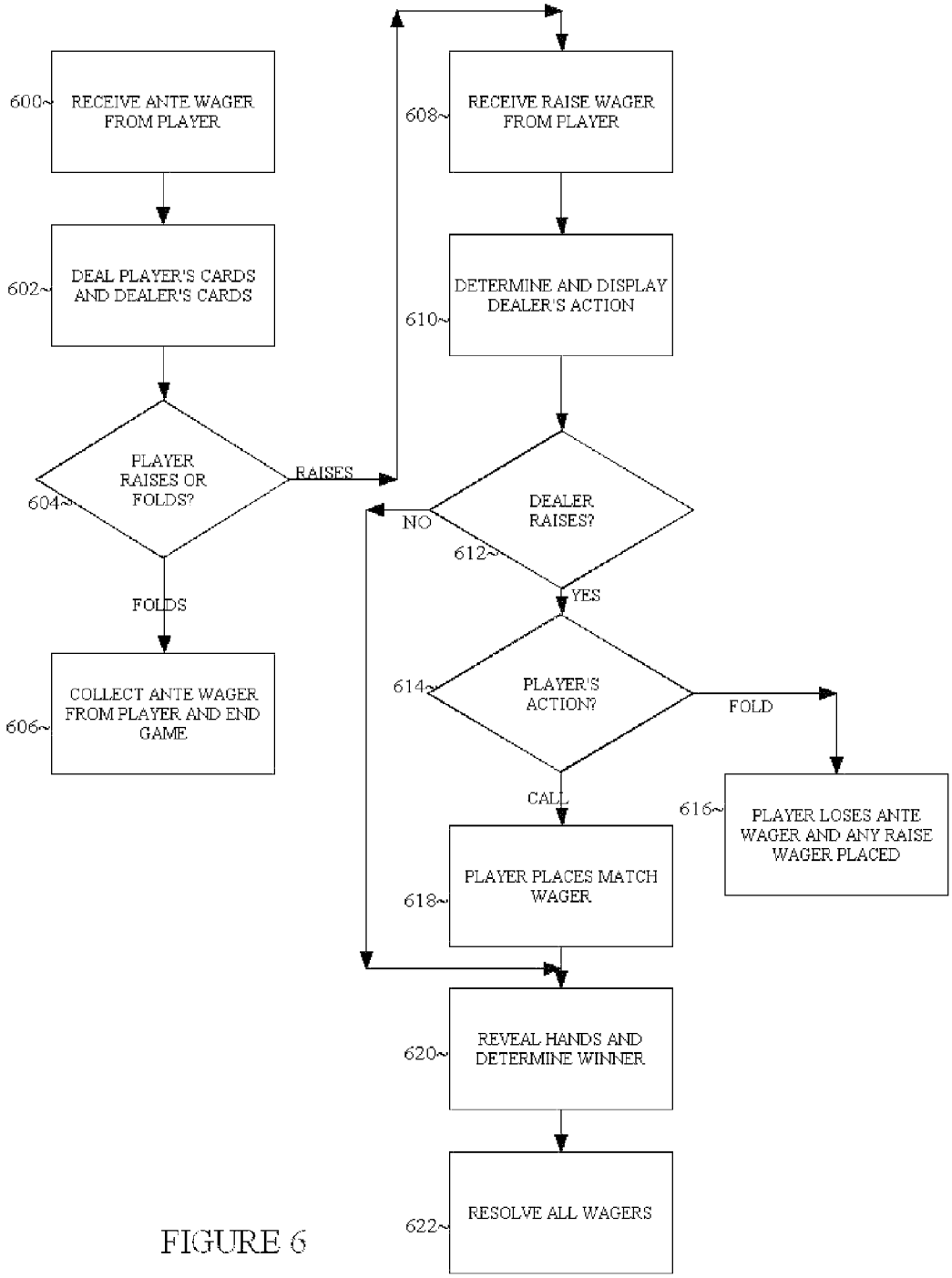
FIG. 6 is flowchart illustrating a further method of implementing a poker game involving a dealer raise, according to an embodiment.

Further embodiments can be implemented. For example, the player can have a chance to raise or fold first, before the dealer indicates the dealer's action. FIG. 6 is flowchart illustrating a further method of implementing a poker game involving a dealer raise, according to an embodiment.

The method can begin with operation 600, which receives an ante wager from a player.

The method proceeds to operation 602, which deals the player's cards (forming the player's hand) and the dealer's cards (forming the dealer's hand). Typically, both the player's hand and the dealer's hand are dealt face down.

From operation 602, the method proceeds to operation 604, wherein the player determines whether the player decides to raise or fold. If the player does not want to raise (place a raise wager), but instead wants to fold, then the method can proceed to operation 606. The raise wager can be equal in amount to the ante wager, or it can be some other multiple. If the player folds, then the method proceeds to operation 606, wherein the house collects the ante wager from the player and the game ends.

If in operation 604, the player decides to raise, then the method proceeds to operation 608, which receives the raise wager from the player. For example, if the ante wager placed in operation 600 is $1, then the raise wager the player must place is $1, or in other embodiments, predetermined multiples of the ante wager (e.g., 2×, 3×, 5×, etc.) In another embodiment, the player is allowed to make more than one possible raise amount (e.g. the raise may be either 1×, 2×, or 3×, depending on the player's choice). For example, the player's raise wager may be placed in the "raise" wagering area of FIG. 4B.

From operation 608, the method proceeds to operation 610, which determines and displays the dealer's action. This can be done as described herein, wherein the dealer's cards are electronically recognized and the dealer's action is determined using a predetermined method (such as any of the ones described herein).

From operation 610, the method proceeds to operation 612, which determines whether the dealer raises (from the dealer's action in operation 610). If the dealer does not raise, then the method proceeds to operation 620. In another embodiment, the dealer always raises a minimum amount, but may make a greater raise.

If the dealer raises, then the method proceeds to operation 614, wherein the player determines what the player's action will be. If the player does not want to invest an additional wager, then the method proceeds to operation 616, wherein the player folds and the player loses his or her ante wager (placed in operation 600) and any raise wager (placed in operation 608).

If in operation 614, the player decides to call the dealer's raise (e.g, place an additional wager equal to the amount of the dealer's raise), then the method proceeds to operation 618, wherein the player must match the dealer's raise (from operation 610). For example, if in operation 610, the dealer's action is determined to be a 1× (one times) raise, then the player must place a match wager equal to the amount of the ante wager. If in operation 610, the dealer's action is determined to be a 2× (two times) raise, then the player must place a match wager equal in amount to twice the ante wager. Depending on the embodiment of the game the dealer's action can comprise a plurality of different raise multiples. For example, the player's match wager may be placed in the "match" wagering area of FIG. 4B.

From operation 618, the method proceeds to operation 620, which reveals both the player's hand and the dealer's hand and determines the winner. The winner is determined by which player has the highest poker rank, using standard poker hand rankings (as known in the art).

From operation 620, the method proceeds to operation 622, which resolves all wagers. If the player loses (e.g., the dealer's hand is a higher poker rank than the player's hand), then the player loses the ante wager (placed in operation 600), any raise wager placed (in operation 608), and any match wager placed (in operation 618). Any other wagers placed (e.g., side wagers) can be resolved now as well.

If the player has the higher poker rank over the dealer's hand, then the player wins. The player can win payouts on the ante wager (placed in operation 600), any raise wager placed (in operation 608), and any match wager placed (in operation 618). Payouts can be even money or other multiple (e.g., 2×). Different wagers can have different payout amounts. For example, the ante wager can push on a win (or pay 1:1), the raise wager can pay 1:1 or 2:1 on a win, and the match wager can pay 1:1 or 2:1 on a win. Any combination or value of payouts can be used. Further, bonus hands can be paid out as well, for example, the ante wager and/or match wager and/or raise wager can pay a special bonus if certain hands are achieved by the player (e.g., flush, three of a kind, etc.) Put another way, the payouts may be listed in a paytable based on the value of the player's hand, or the dealer's hand, or a combination.

If the player's hand and the dealer's hand tie (an unlikely event), then this can be handled in numerous ways. The ante wager, match wager, and raise wagers can all push. Alternatively, some can win, lose, or push, depending on the embodiment being implemented.

It can be appreciated by one skilled in the art that numerous variations of the method illustrated in FIG. 6 can be implemented. For example, operations 604 to 608 can be optional and operation 602 can proceed to operation 610 (in other words, the player does not have the opportunity to raise first). Alternatively to (or in addition to) operations 604 to 608, the player may have the option in operation 618 to place a match wager larger than the required amount from operation 610. For example, if the player places a $1 ante wager, and the dealer's action is "RAISE 2×," then the player must place a $2 match wager to stay in the game. The player can also place a match wager higher than this (but up to a particular multiple of the ante wager), effectively re-raising the dealer (after which, it would be assumed that the dealer calls, but the dealer may be further provided with the ability to fold). For example the player may be allowed to place a $3 match wager (which is 3 times the ante wager) but not higher. The player may do this, for example, if the player thinks that the player has a very good hand, or that the dealer is "bluffing" and does not have a good hand.

As described herein there are numerous ways that the dealer's strategy can be determined. The dealer's strategy can be determined based on the dealer's hand and an optional random raise factor as well.

Figure 7A:
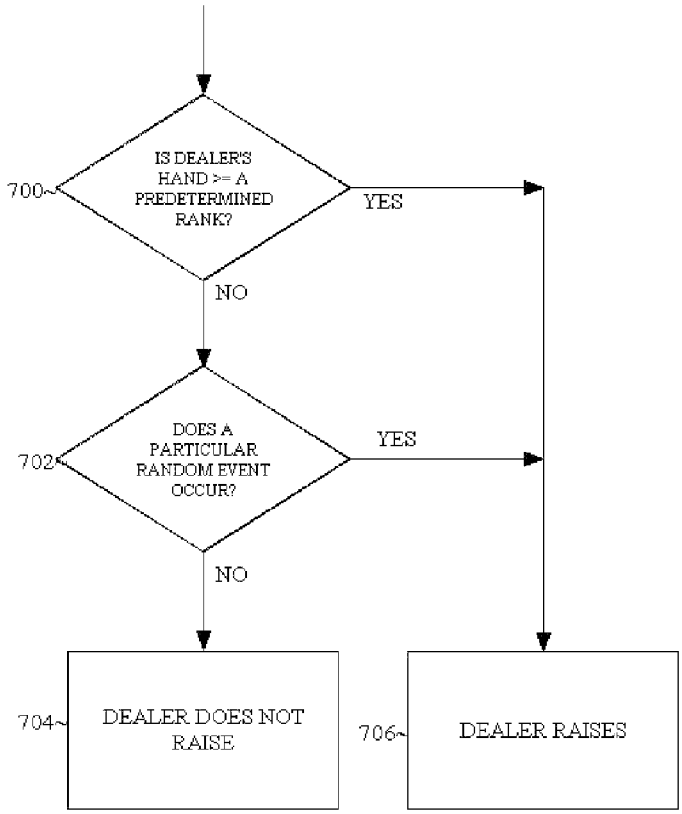
FIG. 7A is a flowchart illustrating a first method of deciding a dealer raise amount, according to an embodiment.

FIG. 7A is a flowchart illustrating a first method of deciding a dealer raise amount, according to an embodiment.

The method can start with operation 700, which determines whether the dealer's hand rank is greater than a predetermined poker rank. If so, then the method proceeds to operation 706, wherein the dealer raises. As described herein, the dealer may not actually place a raise, but may instead provide an indication of what that raise would be (e.g. using indicator 408).

If the dealer's hand rank is not greater than a predetermined rank, then the method can proceed to operation 702, which determines if a particular random event occurs. For example, a random number generator can determine if a random event occurs with a particular frequency (e.g., 10% of the time). If the random event occurs, then the method proceeds to operation 706, wherein the dealer raises.

If the random event does not occur in operation 702, then the method proceeds to operation 704, wherein the dealer does not raise.

It is noted that the order of operations 700 and 702 can be interchanged, that is, the random event can be determined first, and if it does not occur, then it can be determined if the dealer's hand is greater than or equal to a predetermined rank. Generally, if the dealer's hand meets a predefined criteria, then the dealer will raise, but the dealer may also raise if the dealer's hand does not meet the predefined criteria based on a random occurrence.

Figure 7B:
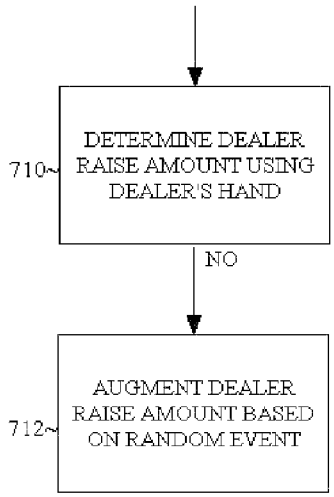
FIG. 7B is a flowchart illustrating a second method of deciding a dealer raise amount, according to an embodiment.

FIG. 7B is a flowchart illustrating a second method of deciding a dealer raise amount, according to an embodiment.

The method can begin with operation 710, which determines a dealer raise amount using a rank of the dealer's hand. For example, a table such as that illustrated in Table I can be used to determine the dealer's raise. This example uses a three card hand, although of course any numbers of cards can be used. The raise amount is typically a multiple of the player's ante wager, although alternatively it can also be applied to any other wager the player has made as well.

TABLE I

| Dealer's hand | Raise (dealer's action) |
|---|---|
| Pair 10's or better | 2× |
| Pair 2's to Pair 9's | 1× |
| All others | 0× |

Thus, for example, according to Table I, if the dealer's three card hand is a pair of kings (e.g., K-spades/K-diamonds/2-hearts), the dealer raise would be 2× and thus the player would have to call by betting an additional two times the player's ante wager (this can be considered the match wager in FIG. 6 and in FIG. 4B) if the player wants to continue in the game. Otherwise, the player would fold by not placing the additional wager and the player would lose the player's ante wager (and any raise wager placed, see operation 608). As another example, if the dealer was dealt: 2-diamonds/5 diamonds/10-spades, the dealer's poker rank is a 10-high, which according to table I would be a raise of 0×, thus the dealer would not raise but would "check" instead (which would not require the player to place an additional wager in this embodiment).

As a further example, a table can be used to determine the dealer's strategy which also may include dealer folding (for example see the embodiment illustrated in FIG. 3). Table II illustrates one example of such table, used with a three card dealer's poker hand.

TABLE II

| Dealer's hand | Dealer's action |
|---|---|
| Pair of jacks or better | Raise 2× |
| King high to Pair of 10's | Raise 1× |
| Ten high to Queen high | Raise 0× (check) |
| Under ten high | Fold |

Once the dealer's strategy is determined in operation 710, then a random factor can be incorporated into the dealer's action. For example, there is a X % (e.g., 10%) chance that the dealer would forget the strategy determined in operation 710 and raise 1× and/or there could be a 5% chance (or any other number) that the dealer would forget the strategy determined in operation 710 and raise 2×. Or there would be an X % chance (e.g., 15% chance) that the dealer would take the next highest action in the chart. For example, if in operation 710, the dealer's action is determined to fold, then on event of a 10% chance (e.g., a random number between 1 and 10=1) then the dealer will check instead of fold; or if the dealer were going to raise 1× and the 10% chance event happens, then the dealer would raise 2× instead of 1× (because 2× is the next highest to 1×). If the dealer were already to raise 2× and the chance event occurs, then the dealer can still raise 2× (or alternatively take a lower strategy).

Operation 712 can be optional, but incorporated a random "bluff" factor into the game may give players more excitement and may encourage players to raise or match the dealer's raise even with a bad player's hand if the player "feels" that the dealer is "bluffing."

In another embodiment operations 700 and 702 (or 710 and 712) may be combined by evaluating whether a random event triggers a raise, and by how much, for the particular hand in question. For example, a dealer hand may be a pair of kings, and the raise amount may be 1× 5% of the time and 2× 10% of the time. In a common implementation, a random number X would be drawn from a random number generating algorithm and evaluated such that if 0<=X<5%, the dealer would raise 1×; if 5%<=X<10%, the dealer would raise 2×; and if X>=10%, the dealer would not raise. As a further example, Table III shows multiple options for dealer actions and their associated probabilities, wherein no specific hand rank always (with 100% probability) has a specific strategy (e.g. raise or check). Table III may be expanded to include more than three possible dealer actions (e.g. raise 1×, raise 2×, raise 3×, fold) or alternate hand rank groupings. A "raise 0×" means that the dealer does not raise but checks, and per common poker parlance that means the player is not required to place an additional wager to stay in the game. However, in other embodiments, the player would be required to place an additional wager at each point in the game regardless of whether the dealer has raised or merely checked.

TABLE III

| Dealer hand | Action 1 (prob.) | Action 2 (prob.) | Action 3 (prob.) . . . |
|---|---|---|---|
| Flush or better | Raise 1× (80%) | Raise 2× (20%) | — |
| Pair to Straight | Raise 0× (10%) | Raise 1× (60%) | Raise 2× (30%) |
| Ten high to Ace high | Raise 0× (40%) | Raise 1× (60%) | — |
| Under Ten high | Raise 0× (70%) | Raise 1× (25%) | Raise 2× (5%) |

Figure 7C:
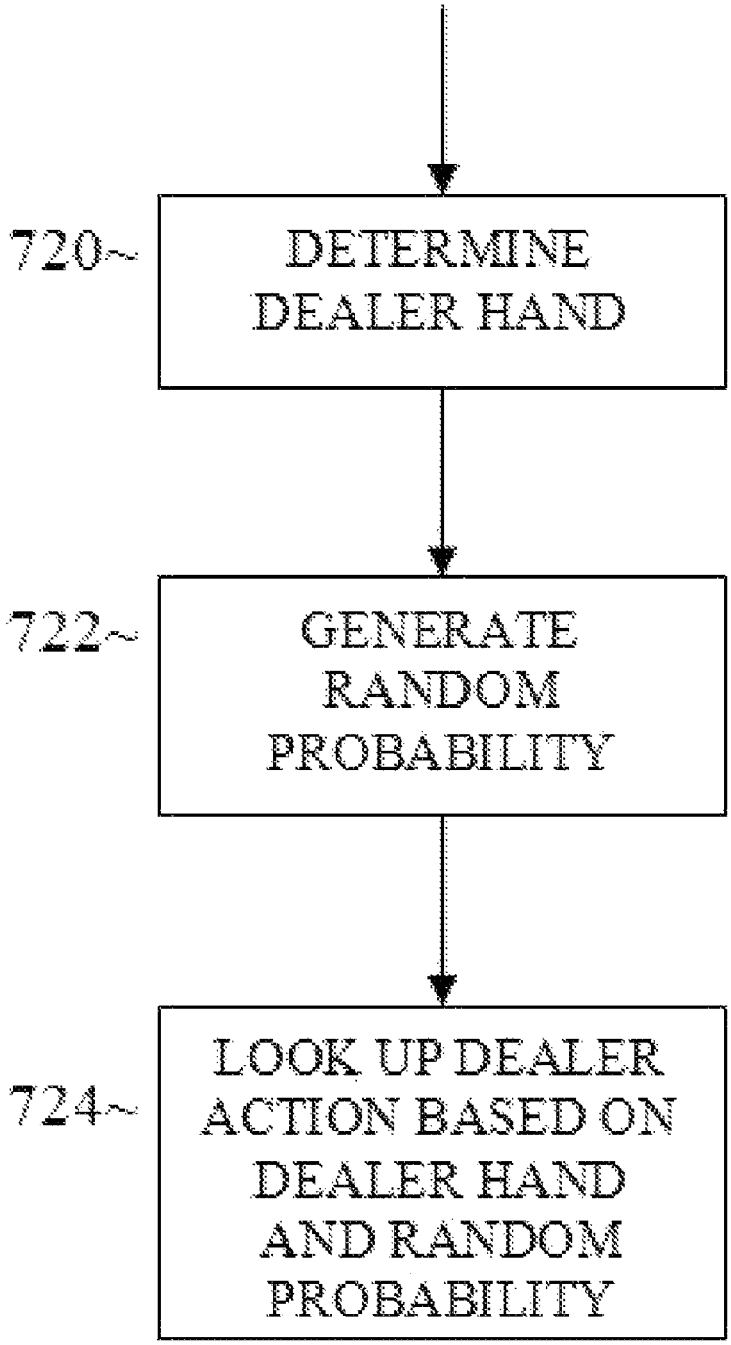
FIG. 7C is a flowchart illustrating a third method of deciding a dealer raise amount based on cards in the dealer's hand, according to an embodiment.

FIG. 7C is a flowchart illustrating a third method of deciding a dealer raise amount based on cards in the dealer's hand, according to an embodiment.

The method can begin with operation 720, which determines the cards in the dealer's hand. This can be done as described herein.

From operation 720, the method can proceed to operation 722, which generates a random probability, for example using a random number generator.

From operation 722, the method proceeds to operation 724, which determines the dealer's action based on the dealer's hand (determined in operation 720) and the random probability (determined in operation 722).

Alternatively, the dealer's action can be determined by determining the dealer's hand, and then determining the possible courses of action using a table (such as Table III) and their respective probabilities, and then picking one of those courses of action based on a generated probability and where it falls into the respective probabilities.

In another embodiment, the dealer's raise strategy is not restricted to grouping by traditional rankings as in Table III, but may include individual hands or sets of hands. For example, the hand "king of hearts, king of diamonds, three of clubs" may have a different set of raise probabilities and amounts than the hand "king of hearts, king of spades, three of clubs", indicating that "a pair of red kings" has its own strategy, apart from whatever may be the strategy for "any pair of kings" or "any pair".

Figure 8:
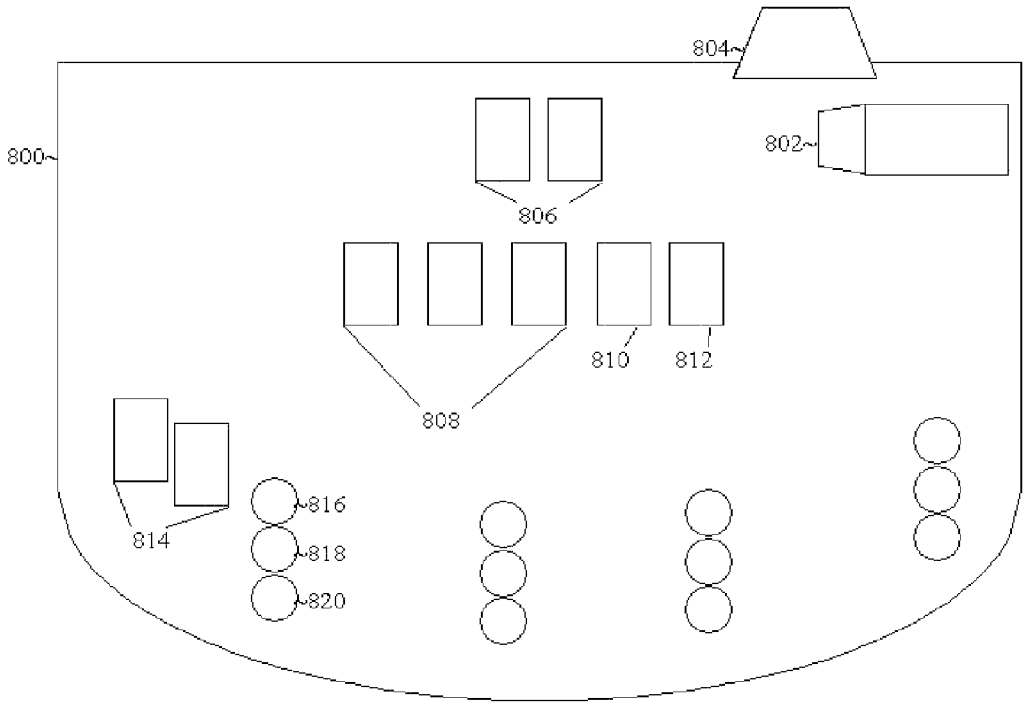
FIG. 8 is a drawing of a table layout illustrating a Texas Hold'em embodiment.

The methods described herein can be applied to all variations of casino player vs. dealer games, which may or may not involve community cards. The popular game of Texas Hold'em can be implemented using the methods described herein. FIG. 8 is a drawing of a table layout illustrating a Texas Hold'em embodiment.

A physical gaming table 800 is used to implement the game. A scanning shuffler 802, of the kind described herein that can electronically scan and identify cards, is used. A dealer's action output display 804 is used to display the dealer's choice of action (e.g., check, raise 1×, raise 2×, etc.) The dealer's hole cards 806, the player's hole cards 814, the flop 808, the turn 810, and the river 812 are shown. A player's ante betting circle 816, a player's first raise betting circle 818, and a players second raise betting circle 820 are shown.

One sequence to implement a Texas Hold'em application of the methods described herein is now described (although it can be appreciated that numerous different sequences can be used as well). A player makes an ante wager using ante betting circle 816. The dealer then deals the dealer's hole cards 806 and the player's hole cards 814 (the hole cards comprise partial hands). The player, after viewing his or her hole cards 814 may decide to fold or place a raise wager using first raise betting circle 818. The three flop cards 808 are now revealed (if already dealt face down) or now dealt face up. It is now the dealer's turn, and the dealer makes the dealer's strategy decision using the dealer's hole cards 806 and the flop cards 808, but not the player's hole cards 814. The dealer's strategy decision can be determined using any of the methods described herein, for example using a matrix (of the kind in Table IV) of hand categories based on the five cards available to the dealer (the dealer's hole cards 806 and the flop cards 808), of which each category has a probability of particular actions (e.g., fold, check, raise 1×, raise 2×, raise 3×, etc.) The raise amounts are multiples of the player's ante wager (e.g., if the player placed a $1 ante wager, and the dealer raises 3×, then the player must wager an additional $3 to continue playing). The dealer's strategy decision (action) is then publicly displayed on the dealer's action output display 804. The player can now decide to fold or match the dealer's strategy decision (e.g., if the dealer raises 2× of the player's original ante amount, the player must put 2× the player's original ante amount in second raise betting circle 820 to continue playing). Then the turn card 810 and the river card 812 are revealed, and the higher hand is determined. The dealer's highest hand is determined based on the best five card hand out of the dealer's hole cards 806, the flop cards 808, the turn card 810, and the river card 812. The player's highest hand is determined based on the best five card hand out of the player's hole cards 814, the flop cards 808, the turn card 810, and the river card 812. If the dealer's highest hand is higher than the player's highest hand, then the player loses all wagers made that are based on the final comparison of the player's hand versus the dealer's hand (e.g., the ante wager, the first raise wager, the second raise wager). Any bonus bets (not pictured) which may not be dependent on such a comparison can be resolved independently. If the player's highest hand is higher than the dealer's highest hand, then the player wins, and the player would typically win a payout on some or all of the wagers made that are dependent upon the final comparison of the player's hand versus the dealer's hand.

It can be appreciated that many different species of games can be implemented that use different numbers of cards and different points to make raises (either by the player or by the dealer). Community cards may or may not be used. The player and/or dealer may also be allowed to draw (or replace) their cards during the game. It is noted that when it is the dealer's turn to make a strategy decision, the processing unit that makes this determination will use certain predetermined cards when making the determination. The dealer initial hands, partial hands, or final hands, may all be used as a basis for determining the dealer's strategy. It may be that the player is dealt cards that the processor could theoretically use in its strategy decision, but according to house rules would ignore. For example, in the Texas Hold'em example presented above, the dealer's action (or strategy decision) would not take into consideration any of the players' hole cards, since this might be considered "cheating" by the players.

There can be a large number of configurations of embodiments, such as the examples below in Table IV. In Table IV, "player takes action" means that the player will decide to fold or raise (and by how much); "player must match dealer's action or fold" can also permit (depending on house rules) the player to "redouble" the dealer's raise amount (as described herein). Unless otherwise stated, cards dealt to the dealer are not revealed to the players until the end of the game (or otherwise stated).

TABLE IV 1) player places ante wager; deal two cards to dealer and two cards to player; player takes action seeing only player's two cards; reveal three flop cards; dealer computes and shows action based on only dealer's two cards and three flop cards; player must match dealer's action or fold; reveal turn card and river card; resolve wagers.

2) player places ante wager; deal three cards to dealer and three cards to player; dealer computes and displays action based on only dealer's three cards; player (seeing only the player's own cards) must match dealer's action or fold; reveal all cards; resolve wagers.

TABLE IV-continued

| |
|---|
| 3) player places ante wager; deal three cards to dealer and three cards to player; player takes action seeing only the player's three cards; deal an addition player's card and an additional dealer's card; dealer computes and shows action based on only dealer's four cards; player must match dealer's action or fold; reveal all cards and resolve wagers. |

Figure 9:
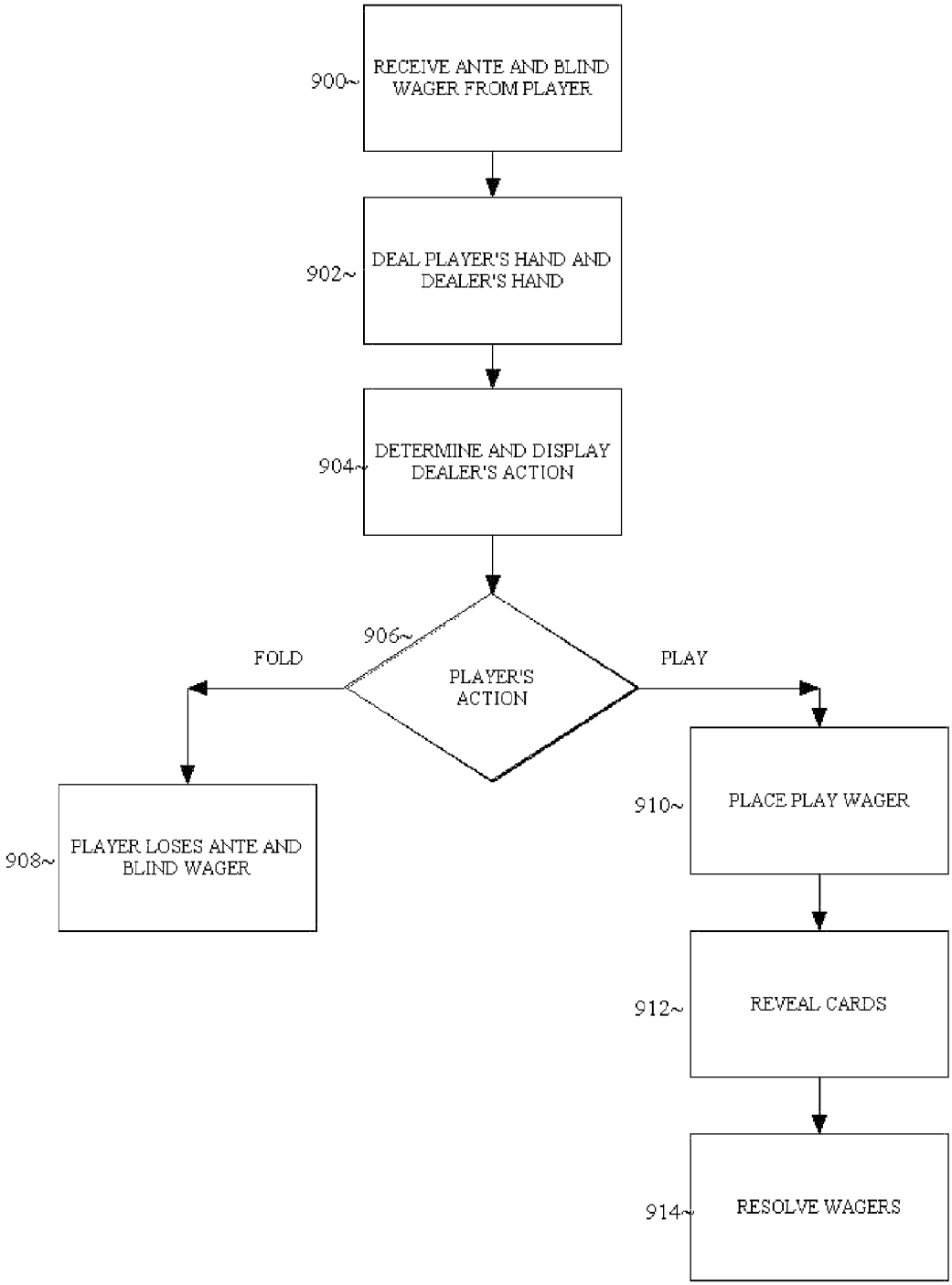
FIG. 9 is a flowchart illustrating an exemplary method of implement a wagering game, according to an embodiment.

FIG. 9 is a flowchart illustrating an exemplary method of implement a wagering game, according to an embodiment.

Figure 10:
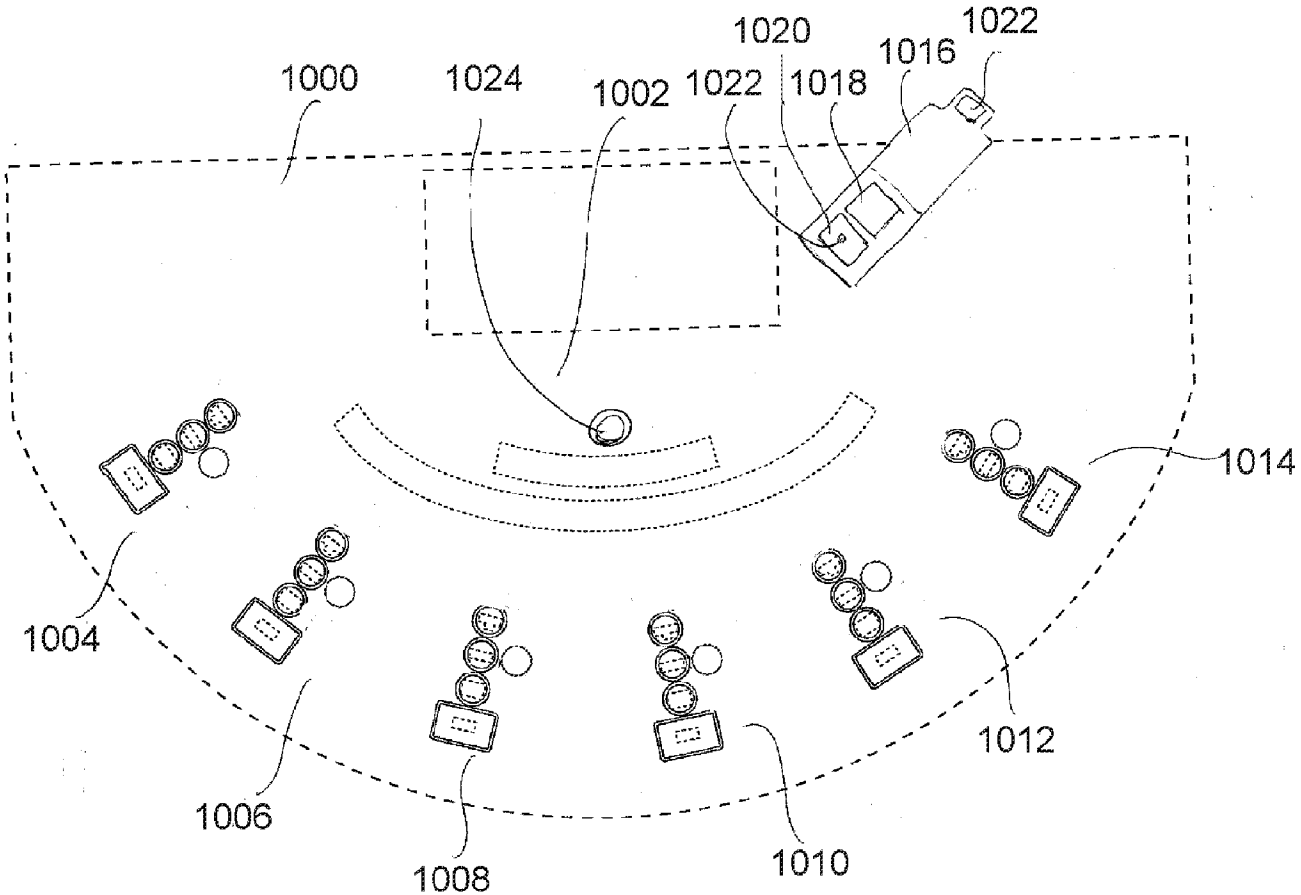
FIG. 10 is a drawing of an exemplary gaming system to implement the methods described herein, according to an embodiment.
Figure 11:
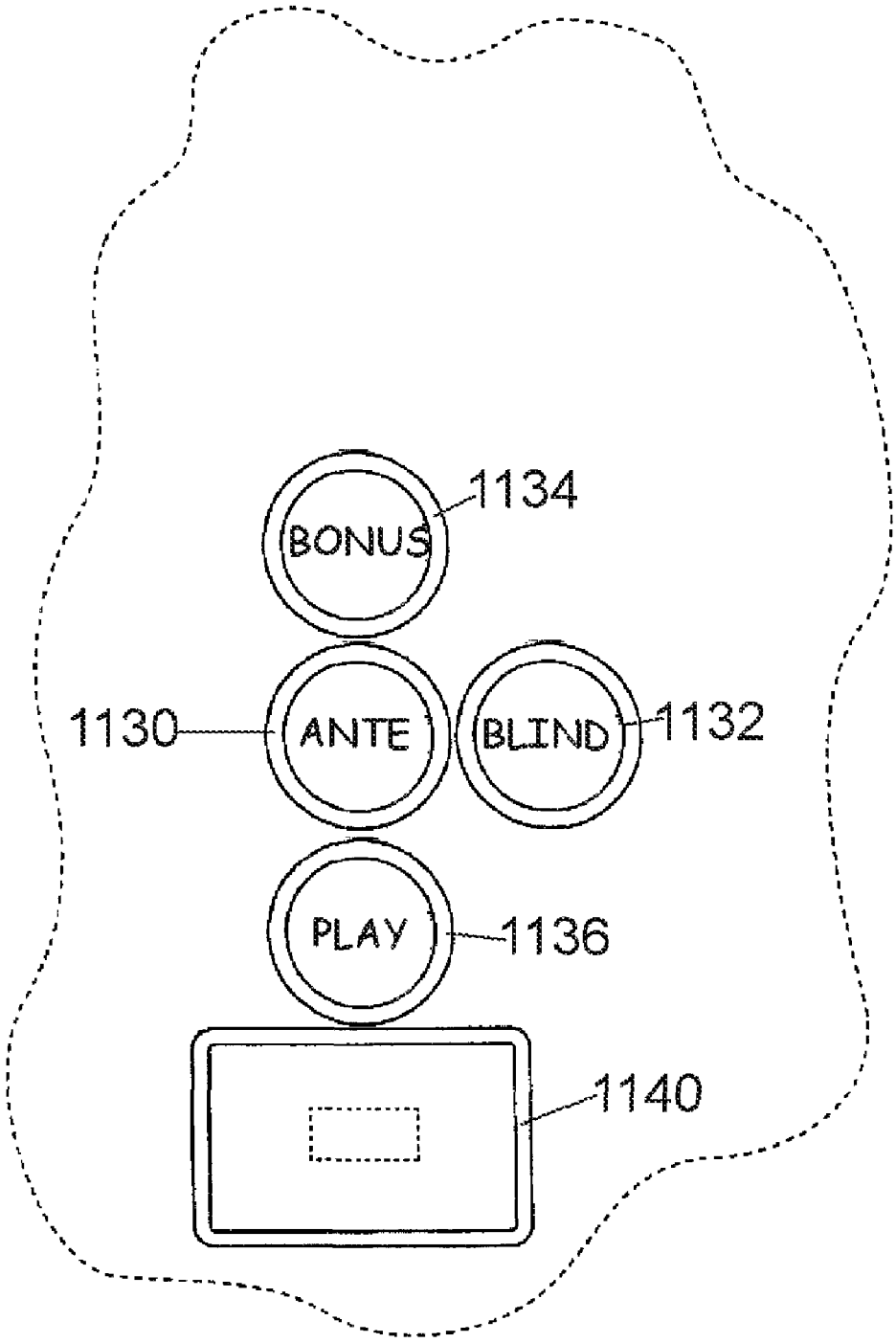
FIG. 11 is a drawing of an exemplary player area, according to an embodiment.

The method can begin with operation 900, which receives a player's initial wagers, which can comprise an ante wager and a blind wager. The ante wager and the blind wager must be equal in value, although in an alternative embodiment they need not be equal. The player may also be able to place a bonus bet. The bets can be placed on betting circles as illustrated in FIG. 11 which can be found on a physical gaming table such as that illustrated in FIG. 10, or can be placed virtually using a virtual chip system which uses a display and computer to manage each player's bets instead of using physical chips.

From operation 900, the method proceeds to operation 902 wherein a human dealer can deal a player's hand and a dealer's hand. A single standard 52 card physical deck of cards can be used, or alternatively multiple or nonstandard decks can be used. The cards can be dealt out of a hand forming scanning shuffler (or shoe or other scanning apparatus) that is described herein. In an embodiment, each player and the dealer can receive six cards, and the player's goal is to make the best five card hand out of the six cards. In other embodiments, other numbers of cards can be used as well. The dealer's cards are typically dealt face down while each player will review their own cards (the respective player's hand). The system (processor) knows what the dealer's cards are by virtue of the scanner.

From operation 902, the method proceeds to operation 904, wherein the dealer's action is determined electronically and displayed to the players at the table. The dealer's action is determined as described in detail herein. The dealer's cards (but not the player's cards) are known to a processor (via the scanning shuffler), which implements algorithms described herein in order to determine the dealer's action (actually instructions to the player as to what the player can now do). The dealer's action (strategy) is displayed to the players using any mechanism, such as the centrally mounted display 1024. When the dealer raises, the dealer does not actually place physical chips on the table in order to raise but instead indicates the raise amount on the centrally mounted display. For example, the dealer may display "2×" which means the player must make a play wager of 2 times the player's ante wager (placed in operation 900) in order to continue playing. This is conceptually related to the match wager of FIG. 4B.

From operation 904, the method proceeds to operation 906, wherein the player takes his or her preferred action and indicates the preferred action to the dealer (either by using hand signals, chip or card positioning, etc.) If the player decides to fold, then the player can indicate as such to the dealer (e.g., by placing his cards in front of his chip), and the method can proceed to operation 908, wherein the player loses both the ante wager and the blind wager. The player's bonus wager is not automatically forfeited and would be paid according to the player's hand using a paytable such as illustrated in Table VI. Alternatively, the player's bonus wager may also be lost if the player folds.

From operation 906, if the player decides to play then the method proceeds to operation 910 wherein the player places a play wager of an appropriate amount. The amount of the play wager is dependent upon the dealer's action displayed in operation 904, as described herein. For example, if the dealer's action is displayed as "2," then if the player wants to continue playing on (to reach operation 912) the player has to make a play wager equal to double the player's ante wager placed in operation 900. If an embodiment of the game being implemented allows redoubling, then the player would have the option to place a play wager of either double the player's ante wager or four times the player's ante wager. The player can simply place his desired wager on the play wager area.

From operation 910, the method proceeds to operation 912, wherein all cards are revealed (all live players' cards and the dealer's cards). Cards from players who have folded would be collected and put into a discard rack, as such these cards would typically not be revealed. At this point of course all of the players will have their eyes on the dealer's cards to see if they have won or lost.

From operation 912, the method proceeds to operation 914, which resolves all wagers. If the dealer's best 5 card hand is greater than the player's best 5 card hand, then the dealer has won and the player loses his or her ante, blind, and play wagers (although in other embodiments some of these bets may push). If the dealer's best 5 card hand is greater than the player's best 5 card hand, then the player has won and is paid on the player's ante, blind, and play wagers. The amounts paid can depend on the rules of the embodiment being implemented and respective paytables. The bonus wager can also be resolved according to the player's hand and a bonus paytable (such as that illustrated in Table VI).

Systems of the present invention may provide more security than systems that only capture the rank and suit of cards as they are dealt into a game. One exemplary system is shown in FIG. 10. In this Figure, a gaming table 1000 is provided with a dealer area 1002, and multiple player areas 1004, 1005, 1008, 1010 and 1012, respectively. The system includes an automatic card shuffler 1016 with random hand-forming and card reading capabilities, as disclosed in U.S. Patent Publication No. 2008/0006997, published Jan. 10, 2008 and assigned to Shuffle Master, Inc., assignee of the present invention. The content of this disclosure is hereby incorporated by reference in its entirety. Cards are inputted into a first tray 1018, are fed into the shuffler and are randomized. Hands or partial hands may be formed in the shuffler, and the cards are imaged during card handling. Hands or partial hands are outputted into an output tray 1020 for removal by a dealer as a group and for dispensing to a player. A card present sensor 1022 senses that absence of cards and delivers a next hand to the output tray 1020 for delivery to the next player. Play outcomes, dealer hands, player hands and other useful play information may be displayed on a shuffler display 1022, before, during or after conclusion of play, or upon an input by the dealer to a touch screen control on the display 1022.

Using a card shuffler to form the hands and image the cards has advantages over using table-top card imagers or imagers built into a shoe. By forming the hands within the shuffler and determining rank and suit of the entire hand while the hand is still contained, a digital record of the "expected" hand may be retained for security purposes. For example, a hand forming shuffler can automatically form hands made of three (or any number) of cards, and each hand can then simply be given to each player and the dealer. Thus, since those cards are digitally scanned, the system knows what each group of cards would be. Those digital records can be compared to other data files such as overhead surveillance records, for example, showing an "actual" hand to determine if cards were removed or switched. If cards are imaged prior to forming the hands, and a dealer is able to manipulate the cards as part of a hand forming process, a lower level of security is provided to the casino by the system.

The table 1000 preferably has a play surface with a centrally mounted display 1024 for displaying at least one of the player's wagering options. Alternatively, instead of using the centrally mounted display 1024, an action display 408 as illustrated in FIG. 4A can be used for the same purpose. In one embodiment described below, the displayed information represents only one betting option from multiple betting options. In other embodiments, the instruction represents the only allowed betting option and is therefore a betting instruction. For purposes of this disclosure, a "betting instruction" is defined as at least one betting option available to the player. Such a betting instruction puts limits on the betting options of the player, however.

In one example of the invention, after initial wagering, the players have the option of folding, or making a play wager that is equal to the displayed betting instruction, i.e.—a multiple of the ante wager (e.g., 1×, 2×, 3×, etc.), or may also make a play wager that is equal to twice the ante times the displayed multiple ("redoubling"), e.g, if the ante wager is $1, and the multiple displayed is "2×" then the player can make a play wager of $2 or $4. In one preferred embodiment, the options to be displayed include 1, 2 and 3, representing 1×, 2× and 3× the ante. In another embodiment, the options to be displayed include the symbol A, (indicating an "All in for 1") 1, 2, and 3. The display may be a LED, LCD or other display known in the art. The display may also be a pole mounted upright display (not shown). In other embodiments, other multiples, such as multiples between 1× and 10× are displayed. The "All in for 1" means that the player, in order to stay in the game, must make a wager equal to 1 times the ante but the player is not allowed to redouble or place a higher wager. In an alternative embodiment of the game, another dealer option would be to display a "check" which would allow the player to continue playing without having to place an additional wager. Thus, if the "1×" is displayed, the player can bet 1 times the ante wager or redouble for 2 times the ante wager, but if the "A" symbol indicating an "all in for 1" is displayed the player is limited to betting 1 times the ante wager. It is noted that other multiples besides 1 can be used, for example "all in for 2" means that the player, in order to stay in the game, must make a wager equal to 2 times the ante but is not allowed to redouble or place a higher wager.

According to one aspect of the invention, displayed betting instructions may be assigned a weighted probability so that the when a processor randomly selects the instruction, some instructions occur with greater frequency than with others. It is a matter of design choice to select the specific weights to be assigned to each instruction. In one embodiment, the weights are assigned such that in a majority of instances, the displayed betting instruction is a function of the strength of the dealer's hand, while less often, the instruction represents a dealer bluff.

In one embodiment, the shuffler's 1016 processor (not shown) is programmed to display the various betting instructions and respective weights. In another embodiment, an external game controller (not shown) communicates with the shuffler 1016 and display 1024 to display the wagering instruction. Either processor may be programmed with the game rules and may have associated memory that stores the game rule programming and game data.

Systems of the present invention may be used as a feature of a variety of wagering games that pit a player hand against a dealer hand. A preferred category of wagering games that may utilize this technology are poker games. Poker hand rankings are well known, especially, 3, 4 and 5-card poker rankings. Other known games that pit a dealer hand against at least one other hand include Baccarat, Blackjack, CASINO WAR and others.

Example Game A

The use of systems of the present invention will be disclosed in the context of an exemplary game that will be referred to in this disclosure as DEALER BLUFF Poker. This game may be played on the table 1000 shown in FIG. 1. It is to be understood that each player area 1004, 1006, 1008, 1010, 1012 and 1014 are substantially identical. One exemplary player area 1004 is illustrated in FIG. 11. Each player area has an ante wagering area 1130 for placing a mandatory ante wager, a blind wager area 1132 for placing a mandatory blind wager, a play wager area 1136 for making a play wager and a Bonus Side Bet area 1134 for placing an optional side bet.

According to the game, each player and the dealer get six cards to make their best five-card poker hands. Player hands are placed in area 1140 on the layout or the cards may be held by the player. Standard 5-card poker rankings apply. Hands are dealt from a standard 52-card deck of cards. Dealer cards are placed face-down in dealer area 1002 in front of the chip tray area 1003.

A unique feature of games of the present invention is that the composition of the dealer's hand is used as a factor in determining what amount the players must make as a play wager to stay in the game, if the player decides to stay in the game. In a preferred embodiment, the players always have the option to fold and lose the ante wager and blind wager. The shuffler reads, forms and records the dealer's hand and a random number generator randomly selects one of multiple player instructions for making a play wager. The selected instruction is displayed, and the player then has the option to fold, make a play wager that is equal to the ante times the displayed instruction, and can optionally double the resulting ante times the displayed instruction. In one embodiment of the game, one of the instructions is an "A" symbol, indicating an "all in for 1." When an "A" instruction is displayed, the player has the option to fold or make a play wager that is equal to the ante. The player does not have the option to double (or increase) the resulting play wager. In other embodiments, a "check" instruction can be displayed which allows the player to continue playing without making an additional wager.

For the most part, the probability of a dealer requiring higher play bets is higher when the dealer hand is strong and lower when his hand is weak. But, occasionally, the dealer will bluff with a bad hand or camouflage a strong hand with a small bet. The shuffler (or other associated processor) will randomly select from the available options of checking, or requiring the player to make a play wager that is a multiple of the ante and will send an instruction to the display. In some embodiments, players can fold instead of following the displayed instruction or double the amount of the displayed instruction.

To play against the dealer, players must make equal bets on the ante and blind in areas 1130 and 1132 of the layout. Players may optionally make a bonus wager in area 1134 which is a wager on obtaining one of a plurality of predetermined winning hands, expressed in a pay table.

The dealer, working from his left to his right, gives each player and himself a packet of six cards. Players and the dealer make the best five-card poker hand out of the six cards. Standard poker rankings apply. After the dealer hand is dealt, the dealer presses a button on the shuffler (not pictured). This triggers the LCD display 1024 in the middle of the table to light up. In one embodiment, the display will indicate one of: (A), (1), (2) or (3). "A" means "all in for 1" (as discussed earlier). The "1," "2," or "3," is the amount players must make to stay in the game—1× the ante, 2× the ante or 3× the ante. In another embodiment, the display will indicate one of: a 1, 2 and a 3, but no "all in" indicia. The actual indicia that the display uses is not important, as any words, symbols, etc. can be used to designate the dealer's instructions.

Players then have a choice to fold and lose their ante and blind wager. A winning Bonus bet is paid as it is independent of head to head play against the dealer. If an "A" is displayed, the player has the option to make a play wager that is equal to the ante, or the player may fold. If a 1 is displayed, the Player has the option to fold, make a play wager equal to the ante or make a play wager that is equal to twice the 1× wager. If a 2 is displayed, the player can fold, make a play wager that is 2× the ante, or may double that or make a play wager that is 4× the ante. If a 3 is displayed, the player can fold, make a play wager that is 3× the ante, or twice that of 6× the ante.

After all play bets are made, the dealer reveals his cards and makes a best 5-card poker hand. In this embodiment, if the dealer has less than a pair, he refunds each player's ante bet. All other bets receive full action.

When the player beats the dealer, the play bet wins even money. If the ante is still in action, that wager pays even money. The blind wager pays according to the following exemplary blind pay table in Table V:

TABLE V

| | |
|---|---|
| Royal Flush | 1000 to 1 |
| Straight Flush | 200 to 1 |
| Four of a Kind | 50 to 1 |
| Full House | 5 to 1 |
| Flush | 4 to 1 |
| Straight | 2 to 1 |
| Three of Kind | 1 to 1 |
| Other Hands | Push |

The Bonus wager wins if the player has a pair of Aces or better. Bonus payouts are made according to the following bonus pay table in Table VI:

TABLE VI

| | |
|---|---|
| Royal Flush | 50 to 1 |
| Straight Flush | 30 to 1 |
| Four-of-a-Kind | 20 to 1 |
| Full House | 9 to 1 |
| Flush | 8 to 1 |
| Three-of-a-Kind | 5 to 1 |
| Two Pair | 2 to 1 |
| Pair of Aces | 1 to 1 |

When the dealer beats the player, the play bets loses. If the ante is still in play, the ante bet also loses and the blind wager also loses. The bonus bet wins if the player has a pair of Aces or better. If the dealer and the player tie, the play bet pushes, the ante bet (if still in action) pushes, and the blind bet pushes. The bonus wager wins if the player has a pair of aces or better.

In other embodiments of the invention, the system may not require the player to call, and the player may continue playing without making a play wager. In other rule variants, the players may not have the option to double or redouble the play wager amount. In yet other variants, the player cannot fold. Games of the invention may incorporate different draw and discard rules (such as dealing seven cards to make a best five card hand), may incorporate game rules that use three, four, six or 7 card poker rankings as the criteria for determining winning hands, may utilize common cards, flop cards, virtual cards, replacement cards, wild cards, bonus cards and the like.

An alternative description of certain embodiments of the card game method is a poker type variant providing a unique/alternative wagering method and alternative strategic play. The disclosed method includes placing an ante Wager and a blind wager of equal value to participate in a base game prior to receiving dealt card information. The ante and blind wagers are preferably a fixed minimum amount and/or a variable amount, wherein the fixed amount is a predetermined minimum amount and the variable amount is left to the discretion of the player relative to set table limits. Other embodiments of the invention do not include a rule to make a blind wager.

In other embodiments of the invention, a card scanner is provided external to the card handling device, or cards are read in an automatic card reading shoe and the hands are assembled outside of the shoe. These alternative methods of electronically reading the composition of the dealer's hand without revealing the cards to the player (such as by using an eye in the sky camera) are less preferred, because the security of the game is enhanced by automatically determining hand composition rather than just card composition and then allowing a dealer to assemble the hand. If the dealer reveals different cards than the hand formed within the shuffler, the house can detect this event with its surveillance cameras and investigate the possibility of player-dealer collusion and/or cheating. In contrast, if cards are read and then assembled by the dealer, the hand composition is not known by the system.

According to a preferred form of the invention, the gaming system automatically reads the composition of the dealer hand prior to the dealer revealing the hand to himself or herself. The system includes a player display that provides the player with a value representing a multiple of the ante wager. In some embodiments, the display may also display a "A", indicating a "all in" or may display another suitable symbol that indicates an "all in". If the display shows an all-in, the player must make a play wager equal to the ante wager or fold. Otherwise, if a number value is displayed, to stay in the game, the player must make a play wager equal to the ante wager times the displayed number value, and in one embodiment, may double that amount. In one embodiment, the number value is selected from the set of 1, 2 or 3.

The number that is displayed is generally an indication of the strength of the dealer hand. However, according to the invention, some percentage of the time that the dealer has a certain hand ranking, the displayed number will not be an indication of the strength of the hand, but instead will be a bluff. For example, if the dealer holds a straight flush, the system will be programmed to display a 3 (indicating a very strong dealer hand) approximately 75% of the time the dealer actually holds a flush. But 20% of the time the system will display a 2, and 5% of the time the system will display a 1. By weighing the probabilities of occurrence of each of the three possible outcomes, a degree of randomness is introduced that makes the game more exciting for players, and offers information that generally, but not always gives useful information to the player.

In the first embodiment, of a method of the present invention, the player has an option to fold or make a play wager that is 1, 2 or 3× the ante wager, depending on the displayed number. The shuffler or external processor is programmed with a look up table of possible dealer hand compositions, preferably in a reverse order of occurrence, with a Royal Flush occurring the least often, and a "nothing" hand occurring the most often. Probabilities of occurrence are assigned to each available multiple, for each category of hand composition. Preferably, one probability of occurrence is associated with each of the three multipliers.

A matrix (as shown in Table VII below) displays 12 possible known categories of "Dealer Hands" associated with the 3 multiples (1×, 2×, 3×), and each multiple represents the multiple that must be applied to the ante wager to arrive at the amount of the play wager.

The following are examples of two further game play methods of the present invention.

Example B

Players and the Dealer each receive 6 cards to make a best 5-card poker hand. Hands are delivered from an i-DEAL® shuffler that forms random hands and that has card recognition capability. Players make a mandatory ante and blind wager to participate in the game and optionally make a bonus wager. The system randomly selects a player wager instruction from the available options 1, 2 or 3, indicating the multiple of the ante. The instruction is randomly selected taking into account the assigned weight of each option and then the player has the option to fold, make a play bet that is equal to his ante bet, multiplied by the displayed instruction, or make a wager that is 2× the ante times the displayed instruction.

The processor determines the dealer's hand composition and randomly selects the instruction from a table of instructions and weighted probabilities, as shown in Table VII:

TABLE VII

| Dealer's Hand | 1× | 2× | 3× |
|---|---|---|---|
| Royal Flush | 5% | 15% | 80% |
| Straight Flush | 5% | 20% | 75% |
| Quads | 5% | 25% | 70% |
| Full House | 5% | 30% | 65% |
| Flush | 10% | 30% | 60% |
| Straight | 15% | 30% | 55% |
| Trips | 20% | 40% | 40% |
| Two Pair | 30% | 50% | 20% |
| High Pair (10-A) | 35% | 50% | 15% |
| Mid Pair (6-9) | 50% | 40% | 10% |
| Low Pair (2-5) | 60% | 30% | 10% |
| Nothing | 80% | 15% | 5% |

An explanation of the probable occurrence of each multiple, as shown above, is as follows: If the dealer holds a royal flush, the system will randomly select a 1× multiplier 5% of the time (a bluff), a 2× multiplier 15% of the time (a bluff), and a 3× multiplier 80% of the time (a true indication of the strength of the hand). Typically a 3× multiplier is randomly selected more often for a high hand. Most of the time, a displayed 3× multiple is an indication that the dealer holds a very strong hand, and should motivate the player to fold if the player is holding a weak hand. However, even when the dealer has nothing, which would typically result in a 1× multiple being displayed 80% of the time, there is a 5% random chance the system will select a 3× and "bluff" the play of the hand against the player by providing false information to the player that the dealer is holding a high ranking hand.

According to the invention, players may fold, make a play wager that is equal to the displayed multiple times the ante, or may re-raise (redouble) by doubling the allowed play wager. The re-raise option adds volatility and excitement to the game and provides players with additional betting options. In other examples of the game, no re-raise option exists.

According to this game example, if the dealer holds a full house and a 3 is displayed, the player may fold, make a play bet that is 3× the ante wager or may re-raise by wagering 6× the ante wager, at the option of the player. In yet other variants of the game, the player must make the play wager and does not have an option to fold. In other options, the player cannot fold or re-raise. The player typically makes this last wagering decision after viewing all or part of the player hand, and preferably after viewing the entire player hand, but prior to the dealer reviewing any cards in the dealer hand. In other embodiments, the dealer reveals a partial hand of at least one card to the players before the players make the Play or fold wagering decision.

Example C

In another embodiment, the player can be limited to the option of going all in for 1, which means making a play wager that is equal to the ante wager, but may not raise (redouble). A display that is preferably located on the table is programmed to display a "A" or other symbol that indicates that the dealer has gone all in for 1× the ante wager. As with the example A, if the display shows a 1, 2 or 3, the player must fold or make a play wager that is equal to the ante wager times the displayed multiple. If a multiple is displayed, the player also has the option to re-raise or double the amount of the ante, times the displayed multiple. However, if the display shows a "A" or other symbol of equivalent meaning, the player must make a play wager equal to the ante or fold. No re-raising is allowed when the dealer has gone all in.

In this example of the invention, the shuffler (or external processor) is programmed with twelve categories of hand compositions, each with four possible betting instructions ("A", 1×, 2× and 3×), for a total of 48 possible categories of dealer hand outcomes. Each category is assigned a weighted probability of occurrence. The game is played in an identical manner to the play described in Example I, with one exception. In the event the display shows a "A," players must place a play wager equal to 1× their ante wager or fold. The players may not re-raise when the system indicates that the dealer has gone all in.

As shown in Table VIII below, for a dealer Royal Flush outcome, the "A" (or "all in") outcome will be displayed 1% of the time, the 1 multiplier will be displayed 1% of the time, the 2 multiplier will be displayed 6% of the time, and the 3 multiplier will be displayed 92% of the time. The player instructions may be weighted differently, depending on the choice of the game designer.

If the "A" or "all in" symbol is displayed, the player may only make a play wager equal to the ante. If the 1, 2 or 3, players may make a play wager that is equal to the ante, time the displayed multiple or may re-raise by doubling that amount. In any of these cases, the player may also choose to fold. An exemplary matrix of Dealer Hand outcomes, betting requirements and assigned weights is shown in Table VIII below.

TABLE VIII

| Dealer Hand | All-in | 1× | 2× | 3× |
|---|---|---|---|---|
| Royal Flush | 1% | 1% | 6% | 92% |
| Straight Flush | 1% | 1% | 10% | 88% |
| Quads | 1% | 1% | 15% | 83% |
| Full House | 1% | 3% | 15% | 81% |
| Flush | 1% | 5% | 15% | 79% |
| Straight | 1% | 5% | 20% | 74% |
| Trips | 2% | 10% | 33% | 55% |
| Two Pair | 5% | 10% | 55% | 30% |
| High Pair (10-A) | 5% | 25% | 55% | 15% |
| Mid Pair (6-9) | 10% | 50% | 30% | 10% |
| Low Pair (2-5) | 15% | 55% | 20% | 10% |
| Nothing | 25% | 60% | 10% | 5% |

In this embodiment, the ideal player strategy is illustrated in the following Table IX: The "re-raise" or ("redouble") means that the player bets double the dealer betting instruction.

TABLE IX

| Dealer Betting Instruction | Player Strategy |
|---|---|
| All-in (no re-raises allowed): | Fold with K-J-8 or less |
| | Call with K-J-9 and better |
| 1× | Fold with K-J-8 or less |
| | Call with K-J-9 to a pair of 2s |
| | Re-raise with a pair of 3s or better |
| 2× | Fold with a pair of 5s or lower |
| | Call with a pair of 6s to 10s |
| | Re-raise with a pair of Jacks or better |
| 3× | Fold with a pair of 9s or lower |
| | Call with a pair of 10s to a pair of Kings |
| | Re-raise with a pair of Aces or better |

It is to be understood that the game outcomes in the first column in this example of the invention represent categories of game outcomes. For example, the "high pair" category includes all pairs of 10's, Jacks, Queens, Kings and Aces, both mixed suit and suited. Even the highest ranking category of a Royal Flush can occur in four separate suits using standard cards.

In one example of a game of the present invention, each player receives a hand of 6 cards, wherein the dealer is dealt the last hand of 6 cards. The hands are dealt from a single standard 52-card deck. The dealer hand is dealt face-down, and the dealer does not look at his cards before placing them face-down on the table. Once all the cards are on the table, the dealer manually notifies the shuffler by, for example, pressing a button on the shuffler or using a hardwired or wireless communication link thereto. The dealer receives the last hand of cards, and this is one way that the system can be informed of which hand is held by the dealer. Other methods of dealer hand identification can be used, such as providing a user input button at the dealer station and requiring the dealer to depress the input at the time the dealer hand is removed from the shuffler.

The composition of the dealer's hand is stored in memory associated with the processor. After notification of the last card deal, the shuffler's processor correlates the composition of the dealer/last hand of cards to the game rules, such as the ranking of the hand using known 5-card poker rankings as the criteria, and an instruction (all-in, 1, 2 or 3) is randomly selected from the weighted outcomes in the above table. The selected instruction is then displayed on a player display, that is preferably a community player display but could also be a player-specific display. The displayed wagering instruction is typically more often an indication of the strength of the dealer's hand winning the game relative all hands dealt, but at times can be a bluff.

The wagering instruction is randomly selected, but since the probabilities are weighted, the outcome is more often than not useful information to the player, and may be a true indication of the strength of the dealer's hand.

Once all of the players have finished wagering, the dealer reveals the dealer cards and the game is resolved according the game rules. For example, in the case of poker using the best 5 out of 6 dealt cards, standard poker rankings are used to resolve the hands. In some variants of the game, if the dealer has less than a pair, he may be required to refund the ante. In other embodiments, there is no dealer qualification rule. When the dealer has less than a pair, the ante is refunded, but all other bets receive full action. If a player beats the dealer, the Play and ante (if applicable) pay even money, and the blind wager pays according to a pay-table. If the dealer beats the player, the play, ante (if applicable) and blind wagers lose. If the player and the dealer tie, the play, ante (if applicable) and blind wagers push.

Bonus side bet wins if a player has a pair of Aces or better (in one embodiment), regardless of whether the player wins, loses or ties the dealer bet.

An actual example of the game described above in "Example B" will now be presented in order to illustrate a sample outcome of the game. Player places a $1 ante wager in the ante wagering area 1130 and a $1 blind wager in the blind wagering area 1132. Player also places a $5 bonus wager in the bonus wagering area 1134. The dealer then deals six cards to the player (viewable by the Player): 4 spades/5 spades/10 hearts/jack spades/2 spades/3 spades. The dealer also deals six cards to the dealer (not viewable to the Player yet): 3 hearts/3 diamonds/9 clubs/3 clubs/2 hearts/10 clubs. The dealer's best possible five card hand out of the six cards is three 3's (discarding the 2 hearts). Using Table VII, for three of a kind ("trips") the dealer will raise 1× 20% of the time, raise 2× 40% of the time, and raise 3× 40% of the time. The processor, using an electronic random number generator applied to this particular weighted probability distribution, determines that the dealer will raise 2×. The centrally mounted display 1024 displays the dealer's action so that all players at the table can see. The Player must now decide whether to: fold (place no further wager and lose the ante and blind wagers); raise $2 by placing $2 in the play betting area 1136; or redouble by placing a $4 wager in the play betting area 1136. The player decides (since the player may perceive his or her flush to be strong) to redouble and places a $4 wager in the play betting area 1136. Now the dealer reveals all cards on the table. The player's best five card hand is a flush, while the dealer's best five card hand is three of a kind. Since the player has the better hand over the dealer, the player is considered the winner. The ante and the play bet win even money, thus the Player wins $1 on the ante wager and $1 on the play wager. The blind wager is paid according to a paytable, such as Table V, wherein a flush pays 4:1 or $4 to the Player. Since the Player also bet $5 on the bonus wager, according to Table VI, a flush pays 8:1 or $40. The game is now over, the dealer can collect all cards, reshuffle, and deal a new game.

It is noted that while particular parameters of embodiments may be described above, the inventive concepts described herein can be applied to different parameter sets. For example, a game is described wherein a best 5 card hand out of 6 is made, however, other games which make the best N card hand out of P cards can be implemented, wherein N and P can be any reasonable number (e.g., 2-10). Further, cards may be dealt only to the player and dealer, or may be dealt to the player and dealer as well as additional being dealt to a shared community set of cards, as in Texas Hold'em. Further, if community cards are used, all or some number of community cards may be required to be used, as in Omaha Hold'em.

It is further noted that the methods described herein can be played using any number of physical or virtual decks (e.g., 1-8 or more). Standard decks of 52 cards can be used, as well as other kinds of decks, such as Spanish decks, decks with wild cards, etc. The operations described herein can be performed in any sensible order. Any cards dealt can be dealt face down or face up, although cards not intended for the players to see are typically dealt face down until they are revealed at a later time. Instead of dealing cards face down and revealing them at a later point in time, cards can remain undealt (remain in the shoe/shuffler) and can be dealt face up at such point as they are to be revealed to players.

The descriptions provided herein also include any hardware and/or software known in the art and needed to implement the operations described herein. Further, all methods described herein can be programmed on a digital computer and stored on any type of computer readable storage medium, especially when directed toward an electronically-enhanced physical gaming table, or an online/internet implementation of the game. The system, processing unit, computer, etc., that is used to implement the methods described herein can contain all of the necessary memories, data structures, programming, connections, etc., in order to implement all of the methods described herein. Any method described herein also includes any hardware needed to implement the method either described herein or otherwise known in the art.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a wagering game using cards, the method comprising:

providing a physical deck of playing cards;

receiving an ante wager from a player;

dealing, using a hand forming scanning shuffler, player's cards which form all or part of a player's hand and dealer's cards which form all or part of a dealer's hand;

determining a dealer's action using the values of the dealer's cards which are determined using an electronic processor but not the player's cards, the dealer's action being determined by the electronic processor by using a table comprising predefined dealer's card categories, respective dealer's actions, and weighted probabilities, and electronically displaying the dealer's action;

receiving a player's choice of action, the player's choice of action being chosen from a set of actions comprising play and fold;

providing predetermined rules that provide: a) if the player's choice of action is fold, then the player loses the ante wager; b) if the player's choice of action is play, then a play wager is received from the player, the play wager being determined based on the dealer's action and the ante wager and play wager are resolved based on a relationship between the player's hand and the dealer's hand; and implementing the predetermined rules.

2. The method of claim 1, wherein the receiving an ante wager further comprises receiving a blind wager from the player to participate in the game.

3. The method of claim 1, wherein a complete dealer hand is automatically formed by the shuffler.

4. The method of claim 3, wherein all of the dealer's cards are delivered face down.

5. The method of claim 1, wherein a complete player hand is automatically formed by the shuffler.

6. The method of claim 5, wherein multiple complete player hands are automatically formed by the shuffler.

7. The method of claim 1, wherein the dealer's action is at least one instruction selected from the set consisting of check, 1, 2 and 3 times the ante.

8. The method of claim 1, wherein the predetermined rules provide that the play wager is selected from the set comprising checking, a play wager equal to the ante times the dealer's action and a play wager that is twice the amount of the ante wager times the dealer action.

9. The method of claim 1, wherein the predetermined rules provide that the play wager is selected from the set comprising a play wager equal to the ante times the displayed instruction and, if the dealer's action allows, a play wager that is twice the amount of the ante wager times the dealer's action.

10. The method of claim 1, wherein each player and the dealer receives six cards each.

11. The method of claim 10, wherein each player and the dealer makes a best five-card hand.

* * * * *